US008725358B2

(12) United States Patent
Takiguchi et al.

(10) Patent No.: US 8,725,358 B2
(45) Date of Patent: May 13, 2014

(54) WORKING VEHICLE, CONTROL DEVICE FOR WORKING VEHICLE, AND HYDRAULIC OIL AMOUNT CONTROL METHOD FOR WORKING VEHICLE

(75) Inventors: Takahide Takiguchi, Shimotsuke (JP); Satoshi Matsumoto, Oyama (JP); Yoshiaki Saito, Kawaguchi (JP)

(73) Assignee: Komatsu Ltd, Tokyo (JP)

( * ) Notice: Subject to any disclaimer, the term of this patent is extended or adjusted under 35 U.S.C. 154(b) by 690 days.

(21) Appl. No.: 12/736,159

(22) PCT Filed: Mar. 11, 2009

(86) PCT No.: PCT/JP2009/001088

§ 371 (c)(1),
(2), (4) Date: Nov. 5, 2010

(87) PCT Pub. No.: WO2009/116249

PCT Pub. Date: Sep. 24, 2009

(65) Prior Publication Data

US 2011/0040459 A1 Feb. 17, 2011

(30) Foreign Application Priority Data

Mar. 21, 2008 (JP) ..... 2008-072975

(51) Int. Cl.

| | |
|---|---|
| ***E02F 9/22*** | (2006.01) |
| ***G06F 19/00*** | (2011.01) |
| *E02F 3/43* | (2006.01) |
| *F15B 11/00* | (2006.01) |

(52) U.S. Cl.

USPC ..... 701/50

(58) Field of Classification Search

USPC ..... 701/50

See application file for complete search history.

(56) References Cited

U.S. PATENT DOCUMENTS

| | | | | |
|---|---|---|---|---|
| 5,434,785 | A * | 7/1995 | Myeong-hun et al. | 701/50 |
| 6,073,442 | A | 6/2000 | Creger et al. | |
| 2006/0099081 | A1 | 5/2006 | Toda et al. | |

FOREIGN PATENT DOCUMENTS

| | | |
|---|---|---|
| JP | B2-2843002 | 10/1998 |
| JP | A-2001-152921 | 6/2001 |
| JP | A-2004-251441 | 9/2004 |
| WO | WO 2007/043290 | 4/2007 |

OTHER PUBLICATIONS

International Search Report mailed on Apr. 14, 2009 for the corresponding International patent application No. PCT/JP2009/001088.

* cited by examiner

*Primary Examiner* — Khoi Tran
*Assistant Examiner* — Dale Moyer
(74) *Attorney, Agent, or Firm* — Posz Law Group, PLC

(57) ABSTRACT

An object of the present invention is to prevent an unnecessary large amount of hydraulic oil from being supplied to a cylinder when a working vehicle capable of performing both a loading operation and a digging operation is performing the digging operation. When one or a plurality of first digging operation conditions are satisfied and when a second operation condition that it is not detected that the loading operation is being performed is also satisfied, a control unit executes fluid amount reduction control of reducing the amount of hydraulic oil supplied from a first pump to a cylinder that actuates a work equipment.

4 Claims, 19 Drawing Sheets

WORKING VEHICLE, CONTROL DEVICE FOR WORKING VEHICLE, AND HYDRAULIC OIL AMOUNT CONTROL METHOD FOR WORKING VEHICLE

CROSS-REFERENCE TO RELATED APPLICATIONS

This application is a U.S. national stage application of PCT/JP2009/001088 filed on Mar. 11, 2009, and claims priority to, and incorporates by reference, Japanese Patent Application No. 2008-072975 filed on Mar. 21, 2008.

TECHNICAL FIELD

The present invention relates to a working vehicle, a control device for a working vehicle, and a hydraulic oil amount control method for a working vehicle.

BACKGROUND ART

For example, in a wheel loader as a working vehicle for civil engineering, hydraulic pressure is necessary in a digging operation, but the discharge amount sometimes may be small. For example, methods disclosed in Patent Citation 1 and Patent Citation 2 serve to detect the performance of a digging operation.

According to Patent Citation 1, it is determined that a digging operation is being performed when at least one of the below-described conditions (1) to (3) is satisfied: (1) the transmission is engaged in a first gear forward gear ratio, (2) the work equipment is in a digging position, and (3) the travel speed of the vehicle is equal to or less than a predetermined amount.

According to Patent Citation 2, when a bottom pressure of the cylinder exceeds a predetermined value, the digging operation is determined to be started and the supply of hydraulic oil is reduced as a method for resolving the problems associated with the method disclosed in Patent Citation 1.

[Patent Citation 1]
U.S. Pat. No. 6,073,442.
[Patent Citation 2]
Japanese Patent Application Laid-open No. 2004-251441.

DISCLOSURE OF INVENTION

Technical Problem

In addition to the digging operation, the wheel loader sometimes performs a loading operation. The loading operation of the wheel loader as referred to herein is an operation of scooping up the load such as fluid and sand by bucket of work equipment, raising the bucket with a boom, and loading into a loading body of a truck. Therefore, in order to increase the raising velocity of the load, it is desirable that the amount of hydraulic oil supplied to the work equipment be increased.

Meanwhile, in the digging operation, although hydraulic pressure is required, a small amount of hydraulic oil supplied to the cylinder is sometimes sufficient.

Accordingly, in a working vehicle that can perform both the loading operation and the digging operation, the bottom pressure of the cylinder can exceed the predetermined value both in the loading operation and in the digging operation. For this reason, when the technique described in Patent Citation 2 is applied to a working vehicle that performs both the loading operation and the digging operation, an unnecessary large actuation can be provided to the cylinder during the digging operation.

Thus, it is an object of the present invention to prevent an unnecessarily large amount of hydraulic oil from being supplied to the cylinder when a working vehicle capable of performing both the loading operation and the digging operation is performing the digging operation.

Solution to Problem

Other objects of the present invention will become apparent from the following description.

Technical Solution

Reference numerals in parentheses in the following description represent by way of example a correspondence relationship with the elements described in the appended drawings, but these reference numerals are merely illustrative and place no limitation on the technical scope of the present invention.

A working vehicle according to one aspect of the present invention includes a cylinder (128) that actuates a work equipment (51); a first pump (120) that supplies hydraulic oil to the cylinder (128); loading operation detection means (211) that detects whether a loading operation is being performed; and a control unit (212, 213). The control unit (212, 213) executes fluid amount reduction control of reducing the amount of hydraulic oil supplied from the first pump (120), when one or a plurality of first digging operation conditions are satisfied and a second digging operation condition that it is not detected that the loading operation is being performed is also satisfied. It is also possible that the control unit (212, 213) does not execute the fluid amount reduction control when one or a plurality of first digging operation conditions are satisfied, but the second digging operation condition is not satisfied because it has been detected that the loading operation is being performed.

As a result, an unnecessarily large amount of hydraulic oil can be prevented from being supplied to the cylinder when a working vehicle capable of performing both the loading operation and the digging operation is performing the digging operation.

According to the second aspect, in the working vehicle according to the first aspect, the plurality of first digging operation conditions are the following conditions (A) and (B):

(A) a gear ratio designated for a transmission (112) is a predetermined gear ratio, and/or a detected vehicle speed is equal to or lower than a predetermined vehicle speed; and (B) an fluid pressure on a bottom side of the cylinder (128) exceeds a predetermined value.

According to the third aspect, in the working vehicle according to the first or second aspect, the control unit (212, 213) executes fluid amount increase control of increasing the amount of hydraulic oil supplied to the cylinder (128) when it is detected that the loading operation is being performed, over that when it is not detected that the loading operation is being performed.

According to the fourth aspect, the working vehicle according to the third aspect further includes an engine (101); a traveling system (103); a hydraulic device system (104); and a distributor (102) that distributes an output from the engine (101) to the traveling system (103) and the hydraulic device system (104). The traveling system (103) comprises a clutch (110) connected to the distributor (102). The hydraulic device system (104) comprises the cylinder (128) and one or more pumps driven via the distributor (102). The one or more pumps include the first pump (120). The control unit (212, 213) executes at least one of the following control (1) to (3) as the fluid amount increase control:

(1) decreasing a clutch pressure of the clutch (110);

(2) increasing a flow rate of hydraulic oil supplied from the first pump (120); and (3) supplying hydraulic oil to the cylinder (118) also from the second pump (121) included in the one or more pumps, in addition to the hydraulic oil supplied from the first pump (120). For example, the traveling system (103) may include a torque converter (14) converting a torque transmitted between the engine (101) and wheels (18R, 18F), and the clutch (13) may be introduced between the distributor (102) and the torque converter (14) and be connected in series to the engine (10) and the torque converter (14).

According to the fifth aspect of the present invention, in the working vehicle according to any one of the first to fourth aspects, there are at least two groups of conditions from among first to third groups of conditions. Each group of conditions includes at least one condition for determining that the loading operation is being performed. The first group of conditions is a group of conditions relating to expression of operator's will. The second group of conditions is a group of conditions relating to a position of the work equipment. The third group of conditions is a group of conditions relating to a state of the traveling system. The loading operation detection unit (211) detects that the loading operation is being performed when each of the conditions selected one by one from at least two groups of conditions from among the first to third groups of conditions is satisfied.

According to the sixth aspect of the present invention, in the working vehicle according to the fifth aspect, the work equipment (51) is a boom (51) provided rotatably at one side of a vehicle body, and the cylinder (128) is a boom cylinder (128) for rotating the boom (51). The first group of conditions includes at least one of the following conditions (a) and (b):

(a) a boom lever (126) is operated to raise the boom (51); and (b) an extension speed of the boom cylinder (128) takes a positive value.

According to the seventh aspect of the present invention, in the working vehicle according to the fifth or sixth aspect, the second group of conditions includes at least one of the following conditions (c) and (d):

(c) an angle of the boom (51) is equal to or greater than a predetermined angle; and (d) an angle of the boom (51) is less than a predetermined maximum angle.

According to the eighth aspect of the present invention, in the working vehicle according to any of the fifth to seventh aspects, the third group of conditions includes at least one of the following conditions (e) to (h):

(e) a ratio of an input revolution speed and an output revolution speed of the clutch (13) when a brake is off is equal to or greater than a predetermined value, or the brake is on;

(f) a gear ratio set to the transmission (112) is a predetermined gear ratio;

(g) a traveling range set to the transmission (112) has been switched from reverse to forward; and (h) a vehicle speed is equal to or higher than a predetermined speed.

According to the ninth aspect, in the working vehicle according to the fifth aspect, the first group of conditions includes a condition (x) of the boom lever (126) being operated so as to raise the boom (51). The second group of conditions includes a condition (y) of the angle of the boom (51) being equal to or greater than a predetermined angle. The loading operation detection unit (211) detects that the loading operation is being performed when both the condition (x) and the condition (y) are satisfied.

According to the tenth aspect, in the working vehicle according to any of the fifth to seventh aspects, the hydraulic device system (104) includes one or more pumps (120, 121) driven via the distributor (102), the boom (51) provided rotatably at one side of the vehicle body (2), the bucket (52) provided rotatably at one side of this boom (51), the boom cylinder (128) for rotating the boom, the bucket cylinder (129) for rotating the bucket, a first control valve (123) that supplies hydraulic oil discharged from the first pump (120) to the boom cylinder (128) and bucket cylinder (129) correspondingly to the operation amount of the boom lever (126) and bucket lever (125), and a second pump (121) that can supply hydraulic oil to the boom cylinder (128) via the first control valve (123). The first pump (120) and the second pump (121) are included in the one or more pumps (120, 121).

According to the eleventh aspect, a working vehicle includes: a cylinder (128) that actuates a boom (51); a first pump (120) that supplies hydraulic oil to the cylinder (128); a transmission (112), and a control unit (200). The control unit 200 executes fluid amount reduction control of reducing the amount of hydraulic oil supplied from the first pump (120) when the following conditions (A) and (B) are both satisfied:

(A) a gear ratio designated for a transmission (112) is a predetermined gear ratio, and/or a detected vehicle speed is equal to or lower than a predetermined vehicle speed; and (B) an fluid pressure on a bottom side of the cylinder (128) exceeds a predetermined value, at least one of the following conditions (C) and (D) is not satisfied:

(C) a boom lever (126) is operated to raise the boom (51); and (D) an angle of the boom (51) is equal to or greater than a predetermined angle. The "case in which at least one condition selected one by one from at least two condition groups from among the first to third condition groups is not satisfied" can be used instead of the "case in which both conditions (C) and (D) are not satisfied".

The above-described units may be a means. Each unit may be constituted by hardware, a computer program, or combination thereof (for example, some are realized by a computer problem, and the remaining are realized by hardware). The computer program is written in a predetermined processor and executed thereby. When the computer program is information processing written into and executed by the processor, a shtorage region present on hardware resources such as memory can be appropriately used. The computer program may be installed in a computer from a recording medium such as CD-ROM, or may be downloaded into the computer via a communication network.

BRIEF DESCRIPTION OF DRAWINGS

FIG. 1 is an explanatory drawing illustrating the entire configuration of a wheel loader to which a working vehicle according to the first embodiment of the present invention has been applied.

FIG. 2 is an explanatory drawing illustrating schematically the controller functions.

FIG. 3 is a side view of the wheel loader.

FIG. 4 is an explanatory drawing illustrating how a loading operation is performed.

FIG. 5 is an explanatory drawing illustrating schematically working steps of the wheel loader.

FIG. 6 is an explanatory drawing for defining the stature of the boom during the loading operation.

FIG. 7 is a table for setting the clutch command pressure.

FIG. 8 is a table for setting the pump displacement.

FIG. 9 is a flowchart of the processing of detecting a loading operation.

FIG. 10 is a flowchart of the processing conducted to increase the amount of hydraulic oil supplied to the work equipment.

FIG. 11 is a flowchart of the loading operation detection processing according to the second embodiment.

FIG. 12 is a flowchart of the loading operation processing according to the third embodiment.

FIG. 13 is a flowchart of the loading operation processing according to the fourth embodiment.

FIG. 14 is a flowchart of the loading operation processing according to the fifth embodiment.

FIG. 15 is a flowchart of the loading operation processing according to the sixth embodiment.

FIG. 16 is a flowchart of the loading operation processing according to the seventh embodiment.

FIG. 17 is a flowchart of the loading operation processing according to the eighth embodiment.

FIG. 18 is a flowchart of the loading operation processing according to the ninth embodiment.

FIG. 19 is a flow chart of relay ON/OFF switching control.

EXPLANATION OF REFERENCES

1 wheel loader
5 work equipment
11 digging object

BEST MODE FOR CARRYING OUT FOR THE INVENTION

Several embodiments of the present invention will be described below with reference to the appended drawings.

[Embodiment 1]

An embodiment of the present invention will be described below with reference to an application to a wheel loader as a working vehicle. However, the present embodiment can be also applied to other working vehicles that differ from the wheel loader.

Figure 1:
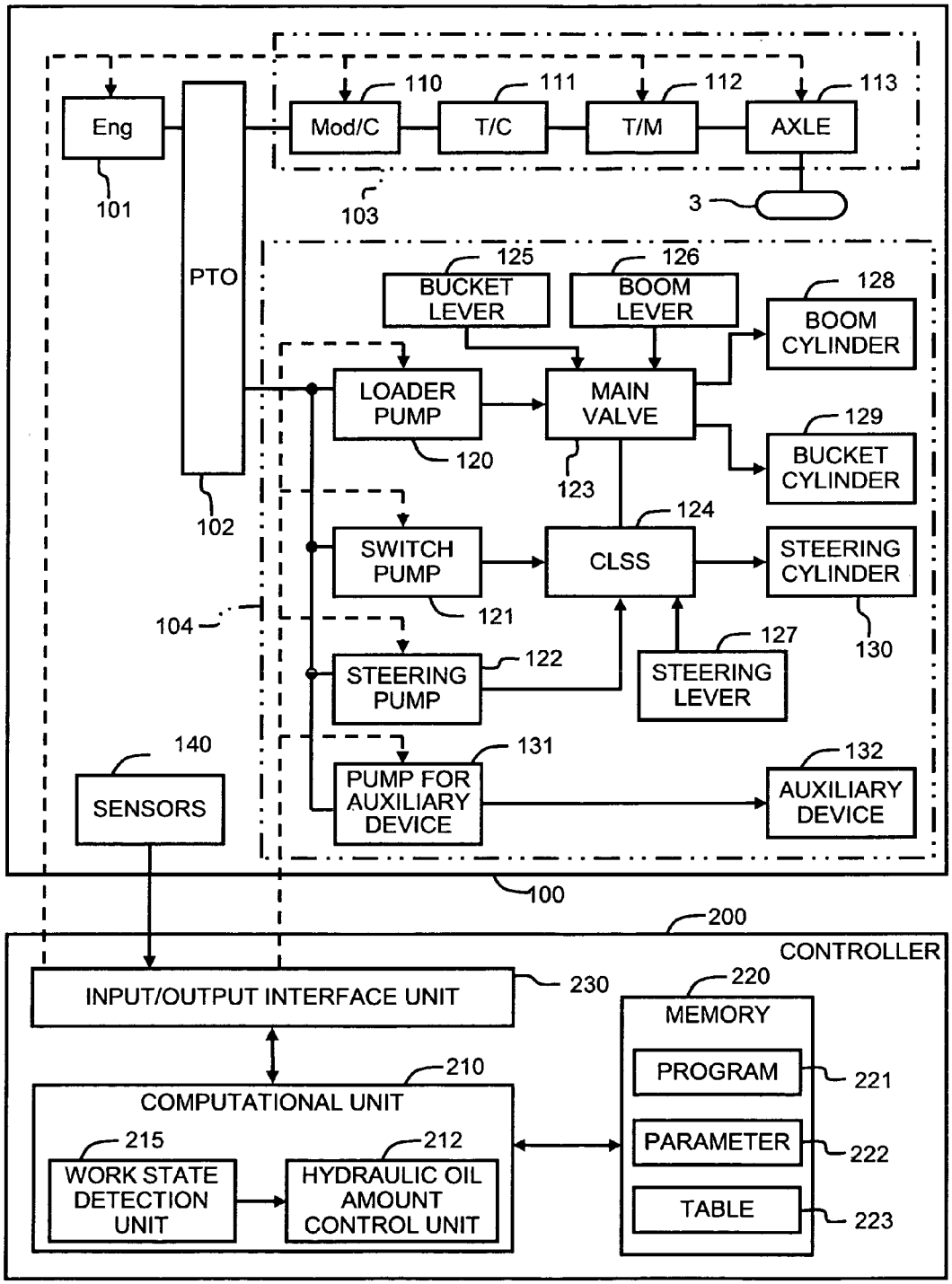
[FIG. 1]

FIG. 1 is an explanatory drawing illustrating schematically the entire configuration of the wheel loader. The wheel loader can be generally subdivided into a mechanical structure 100 and a control structure (referred to hereinbelow as "controller") 200. The mechanical structure 100 has been already explained above. The controller 200 will be explained below.

The mechanical structure 100 includes, for example, an engine 101, a power distributor (PTO: Power Take Off) 102 that distributes the power of the engine 101 to a traveling system 103 and a hydraulic device system 104, the traveling system 103 for causing the wheel loader 1 to travel, and the hydraulic device system 104 for driving mainly a work equipment 5. Because of such a configuration, for example, where the amount of hydraulic oil supplied to the below-described boom cylinder 128 in the hydraulic device system 104 is reduced, a larger portion of the output of the engine 101 is distributed to the traveling system 103.

Figure 3:
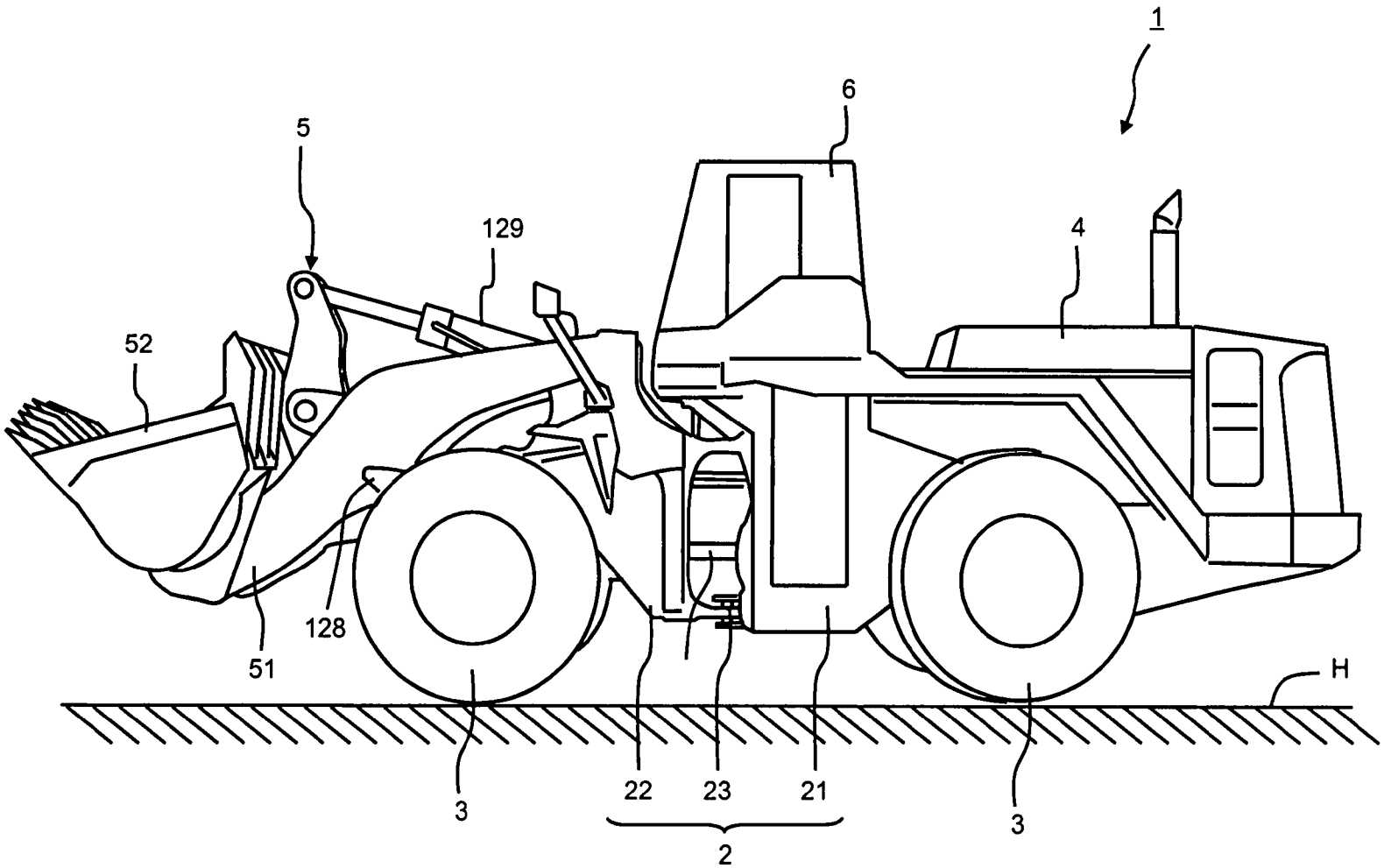
[FIG. 3]

FIG. 3 will be referred to below. FIG. 3 is a side view of the wheel loader 1. The wheel loader 1 includes a vehicle body 2, pairs (left and right) of tires 3 provided at the front and rear sides of the vehicle body 2, a machine room 4 provided at the rear side of the vehicle body 2, the work equipment 5 provided at the front side of the vehicle body 2, and an operator's room 6 provided in the central portion of the vehicle body 2.

The vehicle body 2 is provided with a rear vehicle body 21, a front vehicle body 22, and a joining section 23 that joins the rear vehicle body 21 and the front vehicle body 22. A pair (left and right) of steering cylinders 130 are provided between the rear vehicle body 21 and the front vehicle body 22. Where the operator operates a steering lever 127 (see FIG. 1) within the operator's room 6, a cylinder rod of one of the steering cylinders 130 extends and a cylinder rod of the other steering cylinder 130 contracts in response to this operation. As a result, the pathway of the wheel loader 1 can be changed.

The machine room 4 accommodates the engine 101 and pumps 120. The work equipment 5 is provided with a boom 51 that is provided rotatably so as to extend forward from the front vehicle body 22, and a bucket 52 provided rotatably at the distal end of the boom 51. The wheel loader 1 includes a boom cylinder 128 for rotating the boom 51 in the vertical direction and a bucket cylinder 129 for rotating the bucket 52.

Returning to FIG. 1, the traveling system 103 includes, for example, a modulation clutch (can be also referred to hereinbelow as "clutch") 110, a torque converter 111, a transmission 112, and an axle 113. The engagement and disengagement of the clutch 110 is controlled, for example, hydraulically. More specifically, the clutch 110 is controlled by a hydraulic pressure designated by a control signal with designated hydraulic pressure. The pressure supplied to the modulation clutch 13 will be called hereinbelow "clutch pressure". The controller 200 transmits the control signal that has designated the clutch pressure. For the sake of convenience of explanation, the clutch, torque converter, and transmission are denoted in the figure by symbols "Mod/C", "T/C", and "T/M", respectively. The power (rotation torque) outputted from the engine 101 is transmitted to the tires 3 via the clutch 110, torque converter 111, transmission 112, and axle 113.

The hydraulic device system 104 is configured to include, for example, a loader pump 120, a switching pump 121, a steering pump 122, a main valve 123, a load sensing (steering) valve (in the figure, CLSS: Closed Center Load Sensing System) 124, a bucket lever 125, a boom lever 126, a steering lever 127, the boom cylinder 128, the bucket cylinder 129, the steering cylinder 130, a pump 131 for an auxiliary machine, and an auxiliary implement 132.

The loader pump 120 corresponds to "a first pump", the switch pump 121 corresponds to "a second pump", and the main valve 123 corresponds to "a first control valve". The load sensing valve 124 can be also called "a second control valve".

The loader pump 120 serves to supply hydraulic oil to the boom cylinder 128 and the bucket cylinder 129. The steering pump 122 serves to supply hydraulic oil to the steering cylinder 130. The switch pump 121 serves to supply hydraulic oil to either the steering cylinder 130 or to the boom cylinder 128 and the bucket cylinder 129. The pumps 120, 121, 122 are configured, for example, as swash plate hydraulic pumps and the angles of the swash plates are controlled by control signals from the controller 200.

The load sensing valve 124 mechanically controls the supply destination and supply amount for the hydraulic oil discharged from the switch pump 121 correspondingly to a load. The load sensitive valve 124 can be also called "steering valve". In the usual travel mode, the hydraulic oil discharged from the switch pump 121 is supplied to the steering cylinder 130 via the load sensitive valve 124. Thus, in the travel mode, the switch pump 121 acts to assist the steering pump 122 and actuate the steering cylinder 130. In the present embodiment, a CLSS valve is used as an example of the load sensitive valve (or steering valve) 124, but the present invention can be also applied to configurations using other valves that differ from the CLSS valve.

By contrast, in a working cycle, the hydraulic oil discharged from the switch pump 121 is supplied to the boom cylinder 128 via the load sensitive valve 124 and the main valve 123. Thus, during a loading operation, the switch pump 121 acts to assist the loader pump 120 and actuate the boom cylinder 128.

The bucket lever 125 is a device for operating the bucket 52. The boom lever 126 is a device serving to operate the boom 51. The steering lever 127 is a device for operating the steering cylinder 130. The levers 125, 126, 127 are constituted by, for example, an operation unit operated by the operator and a pilot pressure control valve that controls a pilot pressure correspondingly to the operation amount of the operation unit. The main valve 123 supplies the hydraulic oil discharged from the loader pump 120 (or both the loader pump 120 and the switch pump 121) to the boom cylinder 128 or the bucket cylinder 129 in response to the pilot pressure inputted from the bucket lever 125 or the boom lever 126.

The auxiliary implement 132 is a device such as a cooling fan driven by a hydraulic motor. The pump 131 for an auxiliary implement serves to supply hydraulic oil to the auxiliary implement 132.

Various sensors 140 are provided in predetermined positions inside the mechanical structure 100. The sensors 140 is a general name for sensors 141 to 149 and 151 described below with reference to FIG. 2 (see FIG. 3). Various states detected by the sensors 140 are inputted as electric signals to the controller 200.

The controller 200 is constituted as an electronic circuit provided with, for example, a computational unit (for example, CPU (Central Processing Unit)) 210, a memory 220, and an input/output interface unit 230. The computational unit 210 includes a work state detection unit 215 and a hydraulic oil amount control unit 212.

The work state detection unit 215 has a function of detecting the work state of the wheel loader 1. The hydraulic oil amount control unit 212 has a function of controlling the amount of hydraulic oil supplied to the boom cylinder 128.

The memory 220 stores, for example, a program 221, a parameter 222, and a table 223. The computational unit 210 functions as the work state detection unit 215 and the hydraulic oil amount control unit 212 (in other words, can detect the work state of the wheel loader 1 or control the amount of hydraulic oil supplied to the boom cylinder 128) by reading the program 221 from the memory 220. The parameter 222 as referred to herein is a threshold or a set value that is used by the work state detection unit 215 and the hydraulic oil amount control unit 212. The table 223 as referred to herein is used by the work state detection unit 215 and the hydraulic oil amount control unit 212.

The input/output interface unit 230 is a circuit for transmitting and receiving electric signals between various sensors 140, clutch 110, transmission 112, and pumps 120 to 122, 131. The computational unit 210 receives signals from the sensors 140 via the input/output interface unit 230. Further, the computational unit 210 outputs a control signal to the clutch 110 or pumps 120 to 122, 131 via the input/output interface unit 230. The above-described configuration of the controller 200 is shown in a form simplified to a degree necessary to understand and implement the present invention, and the present invention is not limited to the above-described configuration.

Figure 2:
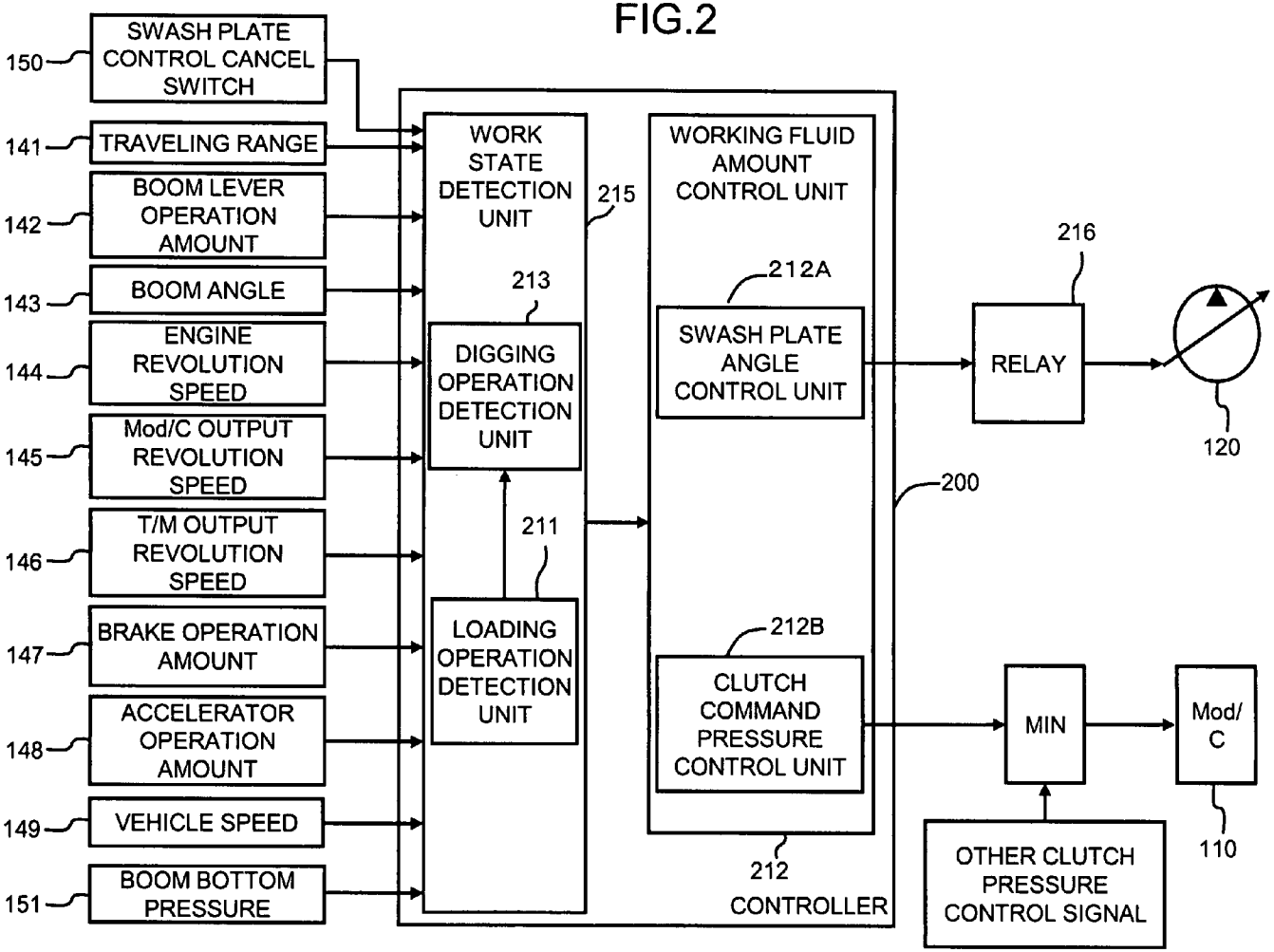
[FIG. 2]

FIG. 2 is an explanatory drawing mainly focused on the functions of the controller 200. A swash plate control cancel switch 150 operated by the operator and sensors 141 to 149 and 151 constituting various sensors 140 are connected to the controller 200.

The swash plate control cancel switch 150 serves to switch between an execution mode and a non-execution mode of the swash plate control. When the swash plate control cancel switch 150 is ON, the swash plate control is in the non-execution mode (for example, the amount of hydraulic oil supplied to the boom cylinder 128 is increased (for example, a maximum value is assumed), and when the swash plate control cancel switch 150 is OFF, the swash plate control is executed.

The travel range sensor 141 detects whether the travel range set to the transmission 112 is Forward (F), Neutral (N), or Reverse (R). The travel range sensor 141 can also detect the number of gear ratios set for the transmission 112. The travel range sensor 141 is not required to be configured as a sensor. The travel range or number of gear ratios can be found by using a signal outputted to the transmission 112 from the transmission control circuit located within the controller 200.

The boom lever operation amount sensor 142 detects the operation direction and operation amount of the boom lever 126. The boom angle sensor 143 detects the angle of the boom 51. The engine revolution speed sensor 144 detects the revolution speed of the engine 101. The clutch output revolution speed sensor 145 detects the revolution speed outputted from the clutch 110. The transmission output revolution speed sensor 146 detects the revolution speed outputted from the transmission 112. The brake pedal operation amount sensor 147 detects the operation amount of the brake pedal in the operator's room 6. The accelerator operation amount sensor 148 detects the operation amount of the accelerator pedal in the operator's room 6. The vehicle speed meter 149 serves as an example of the vehicle speed detection unit and detects the vehicle body speed (vehicle speed) of the wheel loader 1. The boom bottom pressure sensor 151 is, for example, a pressure sensor provided on the bottom side of the boom cylinder 128 and detects the hydraulic pressure (referred to hereinbelow as "boom bottom pressure") at the bottom side of the boom cylinder 128.

The work state detection unit 215 of the controller 200 includes a loading operation detection unit 211 and a digging operation detection unit 213.

The loading operation detection unit 211 functions to detect whether the loading operation is being performed. The loading operation detection unit 211 detects whether the loading operation is being performed by appropriately using signals from the sensors 141 to 149.

The digging operation detection unit 213 functions to detect whether the digging operation is being performed. The digging operation detection unit 213 determines whether the digging operation is being performed on the basis of signals from the swash plate control cancel switch 150, traveling range sensor 141 and the boom bottom pressure sensor 151 and also on the results obtained in determining whether the loading operation is being performed.

Where it is detected that the loading operation is being performed, the hydraulic oil amount control unit 212 increases the amount of hydraulic oil supplied to the boom cylinder 128 by increasing the angle of the swash plate of the loader pump 120 and/or reducing the clutch pressure of the clutch 110. Where it is detected that the digging operation is being performed, the hydraulic oil amount control unit 212 reduces the amount of hydraulic oil supplied to the boom cylinder 128 by decreasing the angle of the swash plate of the loader pump 120.

The hydraulic oil amount control unit 212 is provided, for example, with a swash plate angle control unit 212A and a clutch pressure control unit 212B. The swash plate angle control unit 212A outputs a control signal for controlling the angle of the swash plate of the loader pump 120. The clutch pressure control unit 212B outputs a control signal for controlling the clutch pressure of the clutch 110. The control signal for controlling the swash plate angle of the loader pump 120 will be referred to hereinbelow as "swash plate angle control signal", the control signal for controlling the clutch pressure will referred to as "clutch pressure control signal", and the clutch pressure designated by the clutch pressure control signal will be referred to as "clutch command pressure".

The angle of the swash plate of the loader pump 120 is controlled, for example, by ON/OFF switching the relay 216. More specifically, for example, when the relay 216 is switched from OFF to ON, the angle of the swash plate of the loader pump 120 decreases. Therefore, the amount of hydraulic oil supplied from the loader pump 120 to the boom cylinder 128 is reduced (for example, the amount of supplied hydraulic oil becomes less than the maximum amount). Meanwhile, when the relay 216 is switched from ON to OFF, the angle of the swash plate of the loader pump 120 increases. Therefore, the amount of hydraulic oil supplied from the loader pump 120 to the boom cylinder 128 increases (for example, the amount of supplied hydraulic oil assumes a maximum value).

The swash plate angle control unit 212A sets the relay 216 OFF to increase the flow rate of hydraulic oil discharged from the loader pump 120 when the loading operation is detected. Further, the swash plate angle control unit 212A sets the relay 216 ON to decrease the flow rate of hydraulic oil discharged from the loader pump 120 when the digging operation is detected. The angle of the swash plate of the loader pump 120 may be controlled by a method other than ON/OFF switching of the relay 216. Further, for example, when another swash plate angle control signal is outputted from the other swash plate angle control unit different from the swash plate angle control unit 212A, a swash plate angle control signal representing a larger value is selected from among the swash plate angle control signal from the swash plate angle control unit 212A and the other swash plate angle control signal and the selected signal is inputted to the loader pump 120.

When it is detected that the loading operation is being performed, the clutch pressure control unit 212B outputs a clutch pressure control signal that causes the decrease in clutch pressure to distribute the output of the engine 101 largely to the work equipment 5. Incidentally, when another clutch pressure control signal is outputted from another clutch pressure control unit different from the clutch pressure control unit 212B, a control signal indicating a lower value may be selected from among the clutch pressure control signal from the clutch pressure control unit 212B and the other clutch pressure control signal, and the selected signal may be inputted to the clutch 110. For example, in the case of a working vehicle having a special brake installed thereon (such a special brake will be also referred to as "left brake"), a clutch command pressure produced by the special brake corresponds to one of the aforementioned other clutch pressure control signals.

Figure 4:
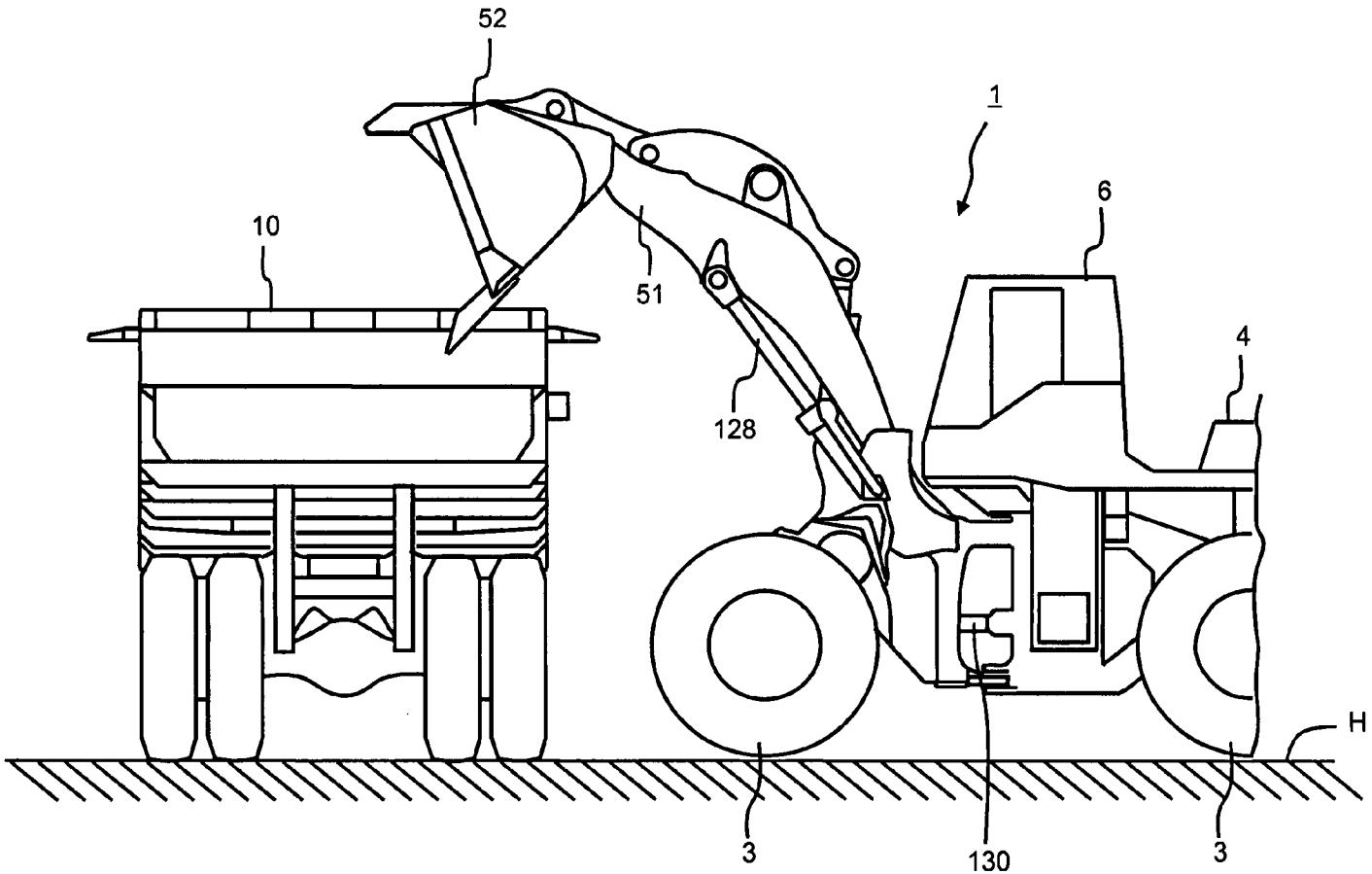
[FIG. 4]

FIG. 4 is an explanatory drawing illustrating the mode of loading operation. The operator lifts the boom 51 to above the load body of a dump truck 10 and rotates the bucket 52 in the dumping direction, thereby dropping the load located in the bucket 52 onto the load body of the dump truck 10.

Figure 5:
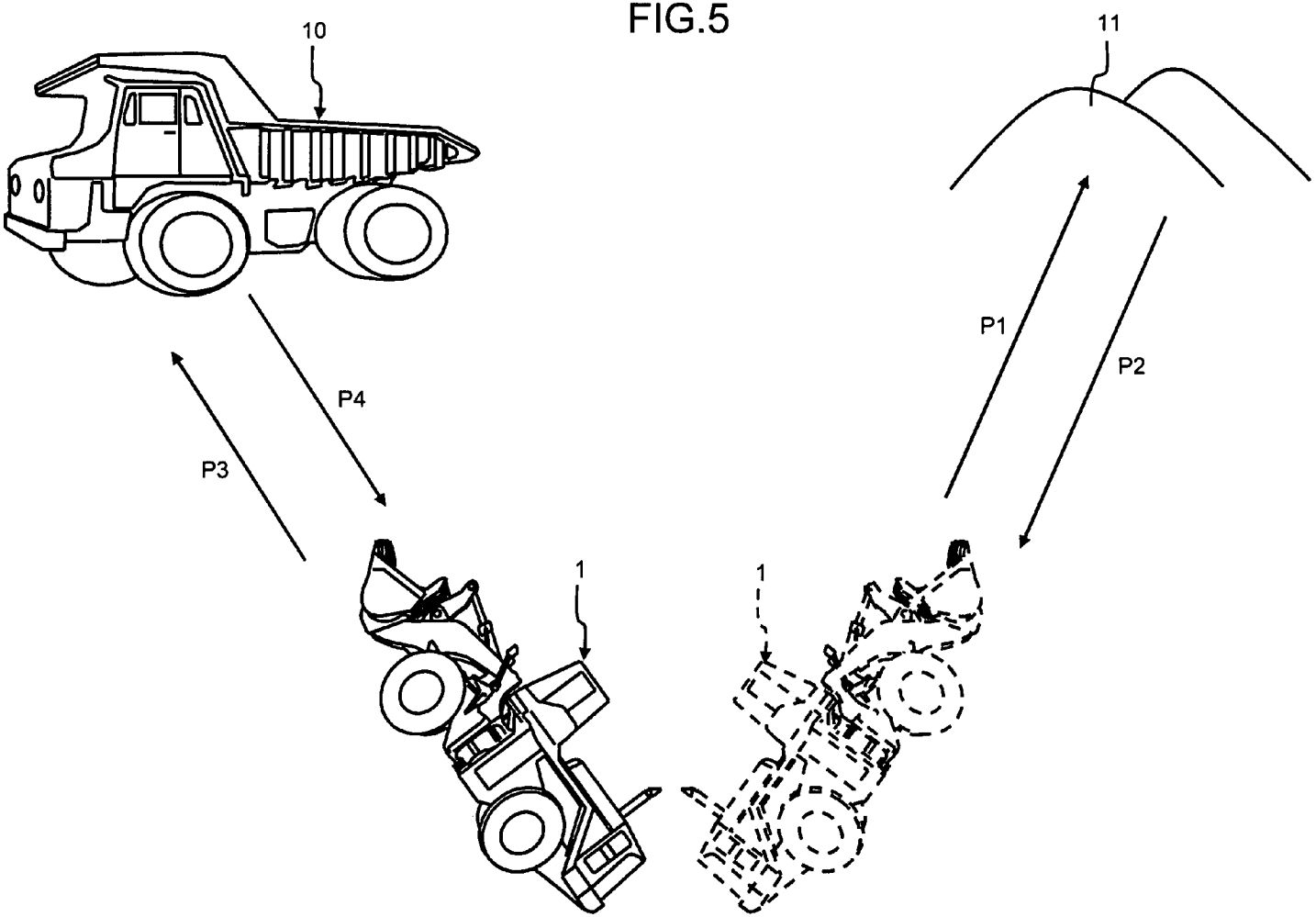
[FIG. 5]

FIG. 5 is an explanatory drawing illustrating schematically the flow of operations of the wheel loader 1. The wheel loader 1 repeats the defined operation of digging a digging object 11 such as earth and sand and loading into a transportation unit such as the dump truck 10.

In the first operation step P1, the operator causes the wheel loader 1 to travel towards the digging object 11 in a state in which the bucket 52 is lowered to a position close to the ground surface. The operator thrusts the bucket 52 into the digging object 11 and then rotates the bucket 52 in the tilting direction to accommodate a load in the bucket 52. In other words, the digging operation is performed in this first operation step P1.

In the second operation step P2, the operator raises the bucket 52 containing the load to a predetermined height above the ground to transfer the wheel loader 1 into a traveling posture and rears the wheel loader.

In the third operation step P3, the operator brings the boom 51 close to the dump truck 10, while raising the boom, and drops the load contained in the bucket 52 onto the loading body of the dump truck 10, as shown in FIG. 4. In other words, the loading operation is being performed in the third operation step P3.

In the fourth operation step P4, the operator rears the wheel loader 1, while lowering the boom 51. Then, a transition is made again to the first operation step P1.

Figure 6:
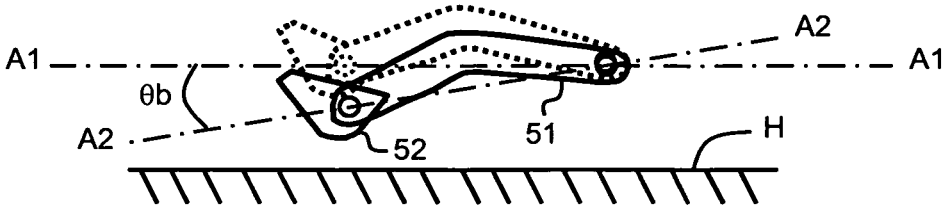
[FIG. 6]

FIG. 6 is an explanatory drawing illustrating schematically the angle of the boom 51 in the initial state in which the loading operation is started. A line passing through the rotation fulcrum of the boom 51 and parallel to the ground surface (horizontal surface) H is taken as a reference line A1-A1, and a line connecting the rotation fulcrum of the boom 51 and the rotation fulcrum of the bucket 52 is taken as A2-A2. An angle formed by the lines A1-A1 and A2-A2 is taken as a boom angle θb. The state in which the boom 51 has been rotated downward through an angle of θ1 from the reference line A1-A1 is taken as negative (minus) and the state in which the boom has been rotated upward is taken as positive (plus). In the present embodiment, these states are detected as initial states in which loading is started. The value of θ<1 is, for example, −10 degrees. However, this value is merely one example and places no limitation on the present invention.

When the line A2-A2 connecting the rotation fulcrum of the boom 51 and the rotation fulcrum of the bucket 52 is in a position above the position assumed by counterclockwise rotation through an angle of θ1 from the reference line A1-A1, the loading operation can be determined to have been started. Thus, in the present embodiment the rise of the boom 51 above the angle of the boom 51 during traveling is detected.

Figure 17:
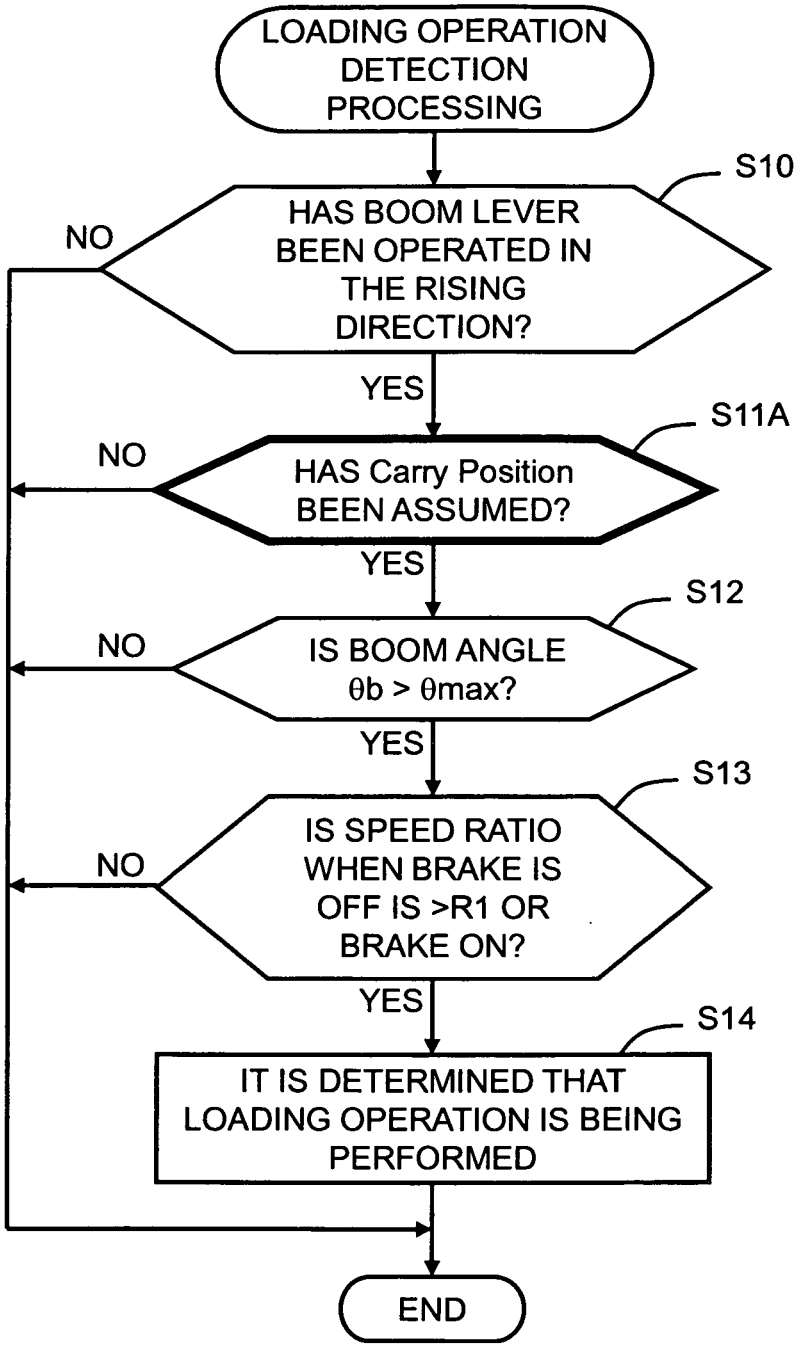
[FIG. 17]

The definitions shown in FIG. 6 are merely exemplary and place no limitation on the present invention. For example, as shown in FIG. 17 described below, "Carry Position" defined by a SAE (Society of Automotive Engineers) standard can be used.

Figure 7:
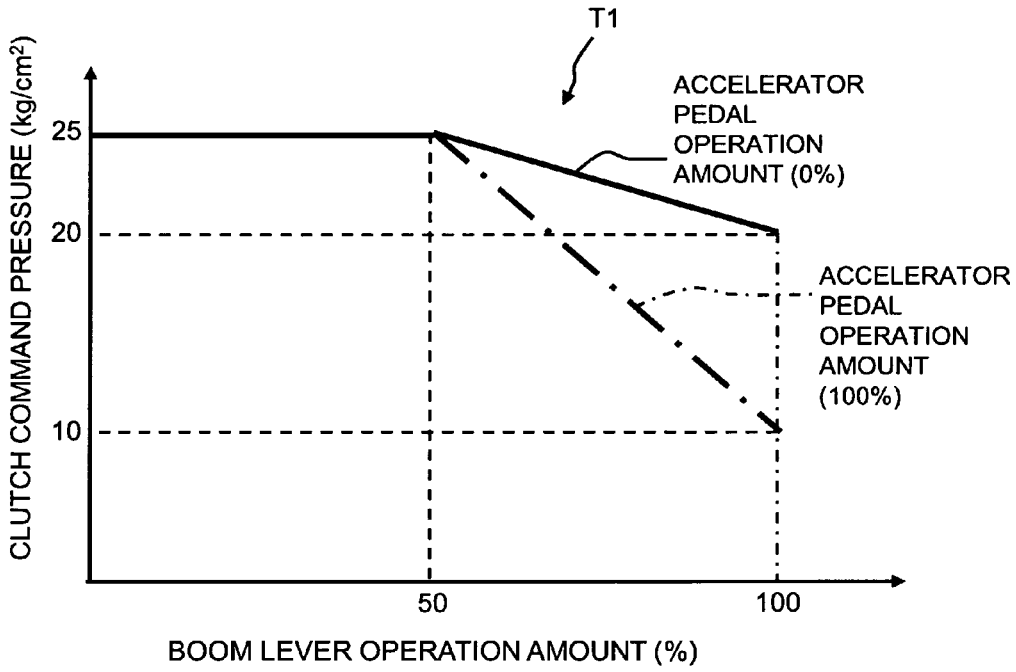
[FIG. 7]
Figure 8:
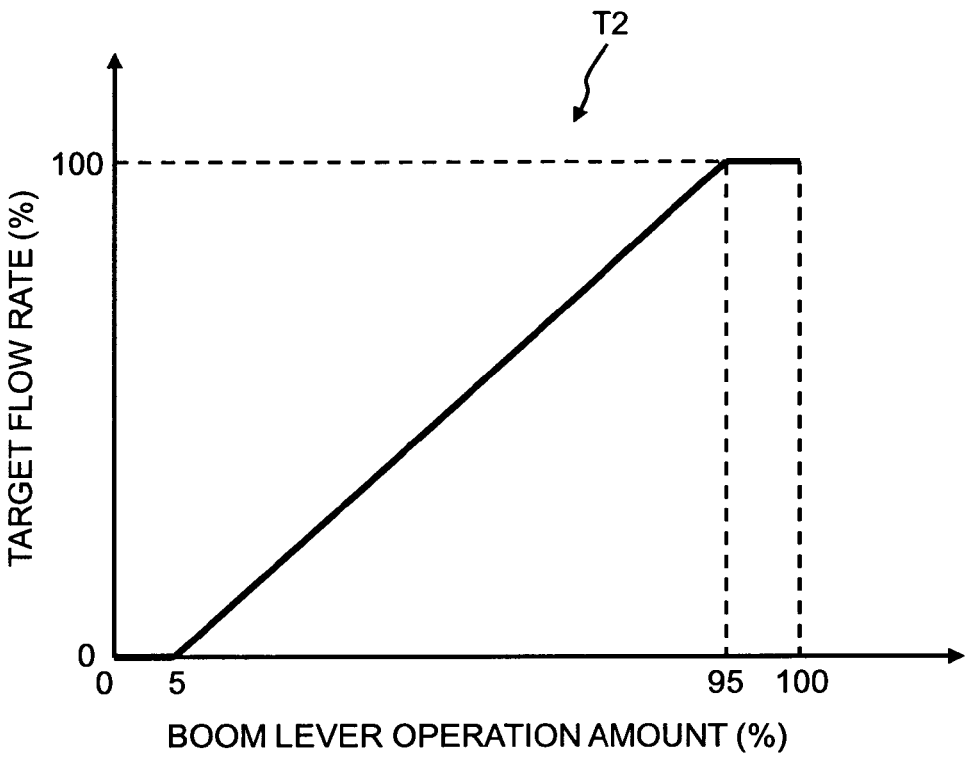
[FIG. 8]

FIG. 7 shows a table T1 that is used to control the clutch command pressure. The tables T1, T2 shown in FIG. 7 and FIG. 8 are examples of the table 223 shown in FIG. 1. An operation amount (%) of the boom lever 126 is plotted against the abscissa in FIG. 7, and a clutch command pressure (kg/cm$^2$) is plotted against the ordinate in FIG. 7. The boom lever operation amount is a lever operation amount in the case in which the boom 51 is raised. A thick solid line in the figure illustrates the case in which the operation amount of the accelerator pedal is 0%, and a dot-dash line in the figure illustrates the case in which the operation amount of the accelerator pedal is 100%. Within a range in which the operation amount of the accelerator pedal is more than 0% and less than 100%, a value is used that is found by interpolation from the 0% characteristic shown by the solid line and the 100% characteristic shown by the dot-dash line.

Within a 0 to 50% range of the boom lever operation amount, the clutch command pressure is increased and the output of the engine 101 is largely distributed to the traveling system. Where the boom lever operation amount exceeds 50%, the clutch command pressure is decreased correspondingly to the boom lever operation amount. The settings are such that the larger is the operation amount of the accelerator pedal the higher is the ratio to which the clutch command pressure decreases. Thus, in the present embodiment, as the operation amount of the accelerator pedal increases, the clutch 110 is made to slip and the output of the engine 101 is largely distributed to the work equipment 5. During the clutch operation with the left brake, the clutch pressure command value produced by the left brake and the command value found from the table T1 are compared with each other, and the lower command value is provided.

FIG. 8 shows the table T2 that is used for controlling the angle of the swash plate of the loader pump 120. A boom lever operation amount (%) is plotted against the abscissa in FIG. 8, and a target flow rate (%) is plotted against the ordinate in FIG. 8. The boom lever operation amount is an operation amount in the case of raising the boom 51. The target flow rate is represented by a ratio to the maximum flow rate. The settings are such that as the boom lever operation amount increases, a flow rate required for the loader pump 120 also increases.

Figure 9:
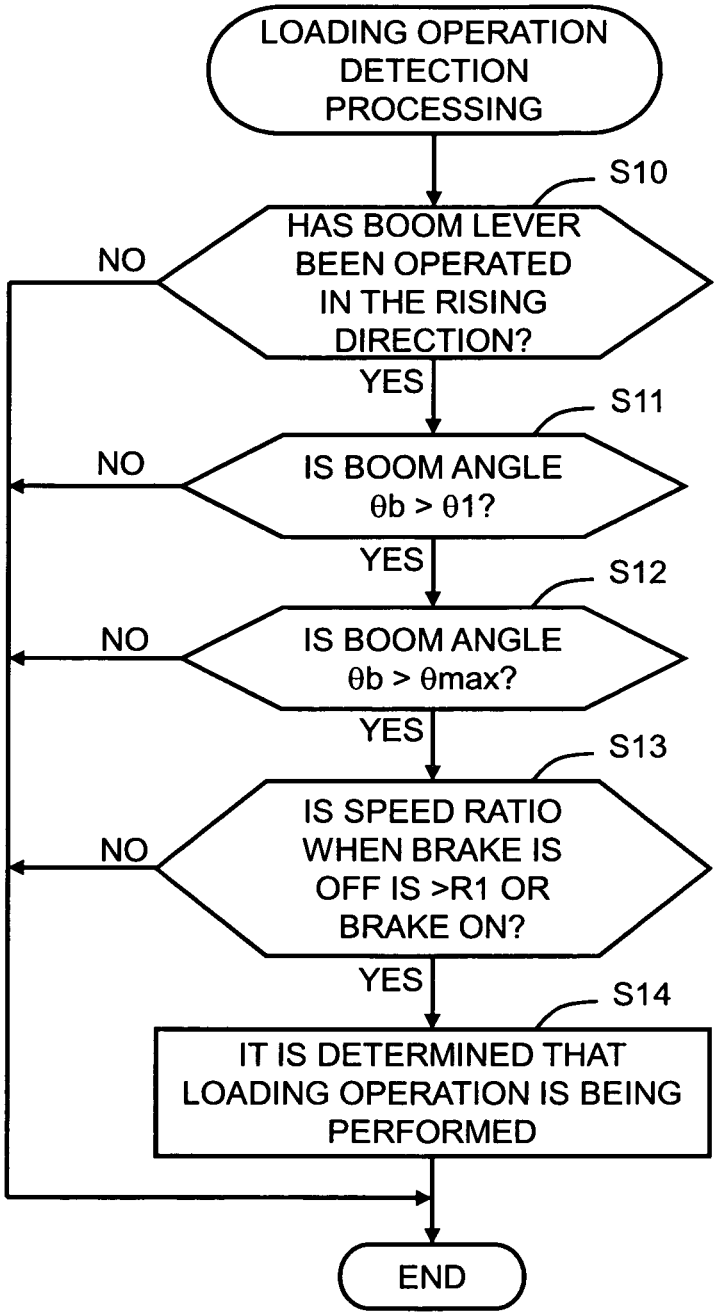
[FIG. 9]

FIG. 9 is a flowchart showing the processing conducted to detect whether the loading operation is being performed. The below-described flowcharts summarize the processing to a degree necessary to understand and implement the present invention. The loading operation detection unit 211 determines that the loading operation (step P3 in FIG. 5) has been started when all of the below-described conditions are fulfilled.

As the first condition, the loading operation detection unit 211 determines whether the boom lever 126 has been operated in the direction of rising (S10). The operation in the direction of rising as referred to herein means an operation performed to raise the boom 51. Because the boom 51 has to be lifted to perform the loading operation, it is determined whether the boom lever 126 has been operated in the direction of rising.

As the second condition, the loading operation detection unit 211 determines whether the boom angle θb is greater than a predetermined angle θ1 that is set in advance (S11). θ1 is set, for example, to −10 degrees. In the loading operation the boom 51 is raised and brought close to the dump truck 10. Therefore, it is determined whether the angle θb of the boom 51 is greater than the angle at the time traveling is started.

As the third condition, the loading operation detection unit 211 determines whether the boom angle θb is less than an upper limit angle θmax that is set in advance (S12). Where the boom 51 has already been raised to the upper limit, the hydraulic oil is no more required. Therefore, it is verified that the boom angle θb is less than the upper limit value θmax.

As the fourth condition, the loading operation detection unit 211 determines whether either the speed ratio when the brake is off is greater than R1 or the brake is on (S13). When the brake is off, it means that the brake pedal has not been operated. The speed ratio as referred to herein is a value obtained by dividing the output revolution rate of the torque converter 111 by the input revolution rate of the torque converter 111. It may be a ratio of the output revolution rate of the clutch 110 and the input revolution rate of the clutch 110. When the brake is on, it means that the brake pedal has been operated and the brake has been actuated.

In the case in which the speed ratio when the brake is on is less than R1 (R1 is, for example, set to 0.3), that is, where the speed ratio is <R1, it means that either the wheel loader 1 is accelerated or the digging operation (step P1) shown in FIG. 5 is performed. In this case, the amount of fluid distributed to the work equipment may be small.

The loading operation detection unit 211 determines that the loading operation is being performed when all the four conditions are satisfied (S14). In this case, the loading operation detection unit 211 writes the parameter 222 meaning that the loading operation is being performed to the memory 220. For example, the loading operation detection unit 211 sets the loading operation flag stored in the memory 220 to a value (for example, "1") meaning that the loading operation is being performed. The loading operation flag is a flag indicating whether the loading operation is being performed.

Figure 10:
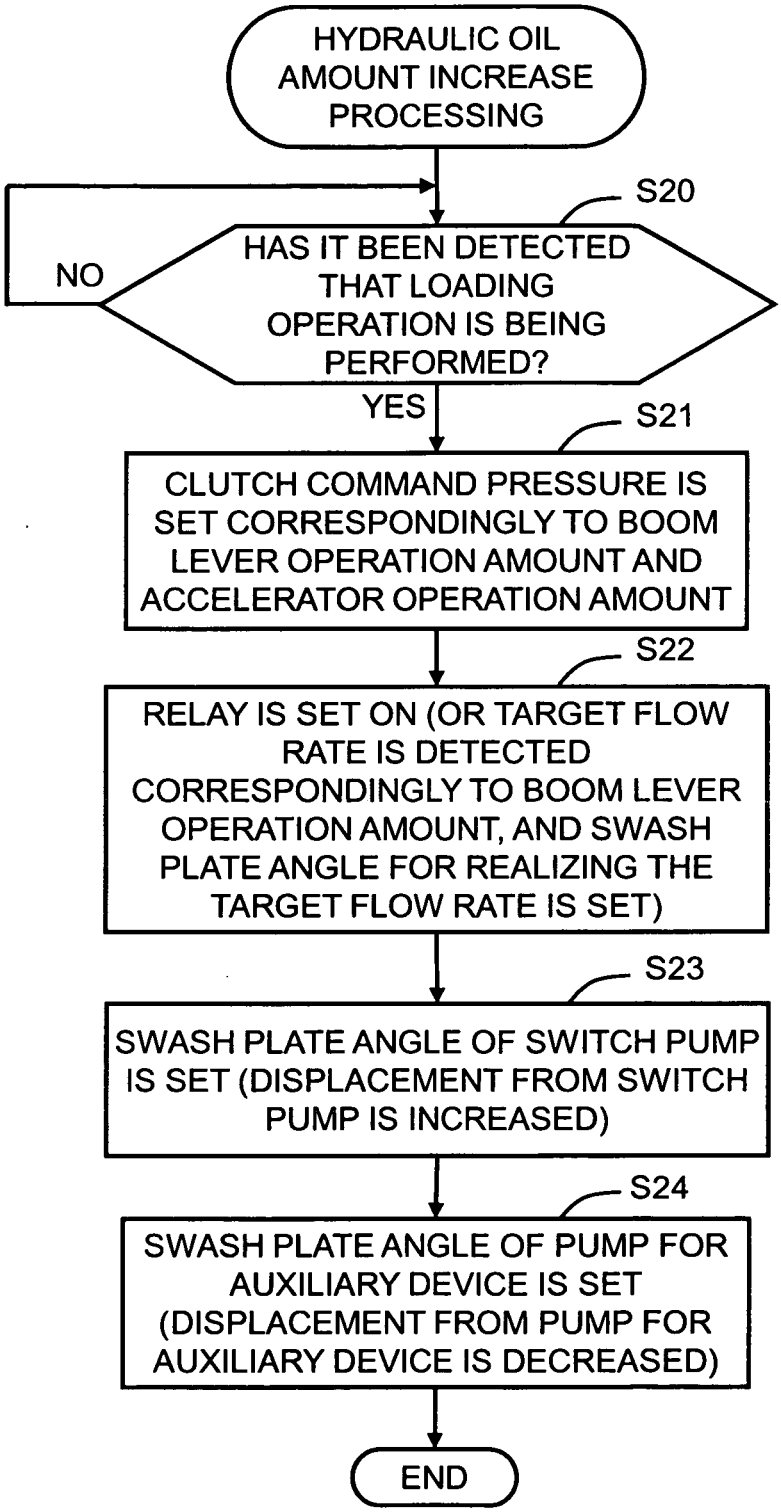
[FIG. 10]

FIG. 10 is a flowchart illustrating the processing conducted to increase the hydraulic oil amount. Where the loading operation detection unit 211 determines that a loading operation is being performed (S20: YES), the hydraulic oil amount control unit 212 executes a plurality of fluid amount increase processing operations described hereinbelow.

In the first fluid amount increase processing, the clutch command pressure control unit 212B of the hydraulic oil amount control unit 212 uses the table T1 shown in FIG. 7 and determines the clutch command pressure to the clutch 110 correspondingly to the accelerator pedal operation amount and boom lever operation amount (S21). The clutch command pressure determined herein is a value less than the present clutch pressure, for example a value for disengaging the clutch 110. The clutch command pressure control unit 212B outputs a clutch pressure control signal indicating the determined clutch command pressure to the clutch 110 (S21). By decreasing the clutch command pressure, the engine power distributed to the hydraulic device system is increased. As a result, it is possible to increase the amount of fluid supplied to the boom cylinder 128.

In the second fluid amount increase processing, the swash plate angle control unit 212A of the hydraulic oil amount control unit 212 turns off the relay 216. Alternatively, the swash plate angle control unit 212A detects the target flow rate corresponding to the boom lever operation amount by using the table T2 shown in FIG. 8, sets the swash plate angle for realizing the detected target flow rate, and outputs a swash plate angle control signal to the loader pump 120 (S22). As a result, the amount of fluid supplied to the boom cylinder 128 can be increased.

In the third fluid amount increase processing, the swash plate angle control unit 212A sets the swash plate angle such that the discharge from the switch pump 121 increases and outputs a control signal to the switch pump 121 (S23). The swash plate angle control unit 212A can set the swash plate angle of the switch pump 121, for example, on the basis of the following computational formula: "(swash plate angle (%) of the switch pump 121)=(swash plate angle (%) determined by the load sensing valve 124)+(increment (%) corresponding to the boom lever operation amount)".

The swash plate angle determined by the load sensing valve as referred to herein is a swash plate angle corresponding by the flow rate determined to be necessary for the operation of the steering cylinder 130. The increment corresponding to the boom lever operation amount as referred to herein is a swash plate angle corresponding to the flow rate determined to be necessary to aid the loader pump 120. When the sum total of the right side of the aforementioned computational formula exceeds 100%, the swash late angle of the switch pump 121 is limited to 100%.

In the fourth fluid amount increase processing, the swash plate angle control unit 212A sets the swash plate angle of the pump 131 for an auxiliary implement and outputs a control signal to the pump 131 for an auxiliary implement such that the flow rate of the hydraulic oil discharged from the pump 131 for an auxiliary implement decreases (S24). Where the pump 131 for an auxiliary implement is connected to the output distributor 102 via a valve clutch, the swash plate angle control unit 212A can release the engagement of the pump clutch instead of controlling the swash plate angle. As a result, the output distributed to the pump 131 for an auxiliary implement is distributed to the loader pump 120.

By implementing the first to fourth fluid amount increase processing in the above-described manner it is possible to supply a larger amount of hydraulic oil to the boom cylinder 128 and increase the rise speed of the boom 51 in a loading operation.

In the present embodiment, cases are described in which the first to fourth fluid amount increase processing operations are executed, but the present invention is not limited to such cases. For example, the hydraulic oil amount control unit 212 may be configured to executed only either of the first fluid amount increase processing (S21) and second fluid amount increase processing (S22). The hydraulic oil amount control unit 212 may execute the first, second, and third fluid amount increase processing (S21, S22, S23), may execute only the first and second fluid amount increase processing (S21, S22), or execute only the first and third fluid amount increase processing (S21, S23) or the second and third fluid amount increase processing (S22, S23).

Figure 19:
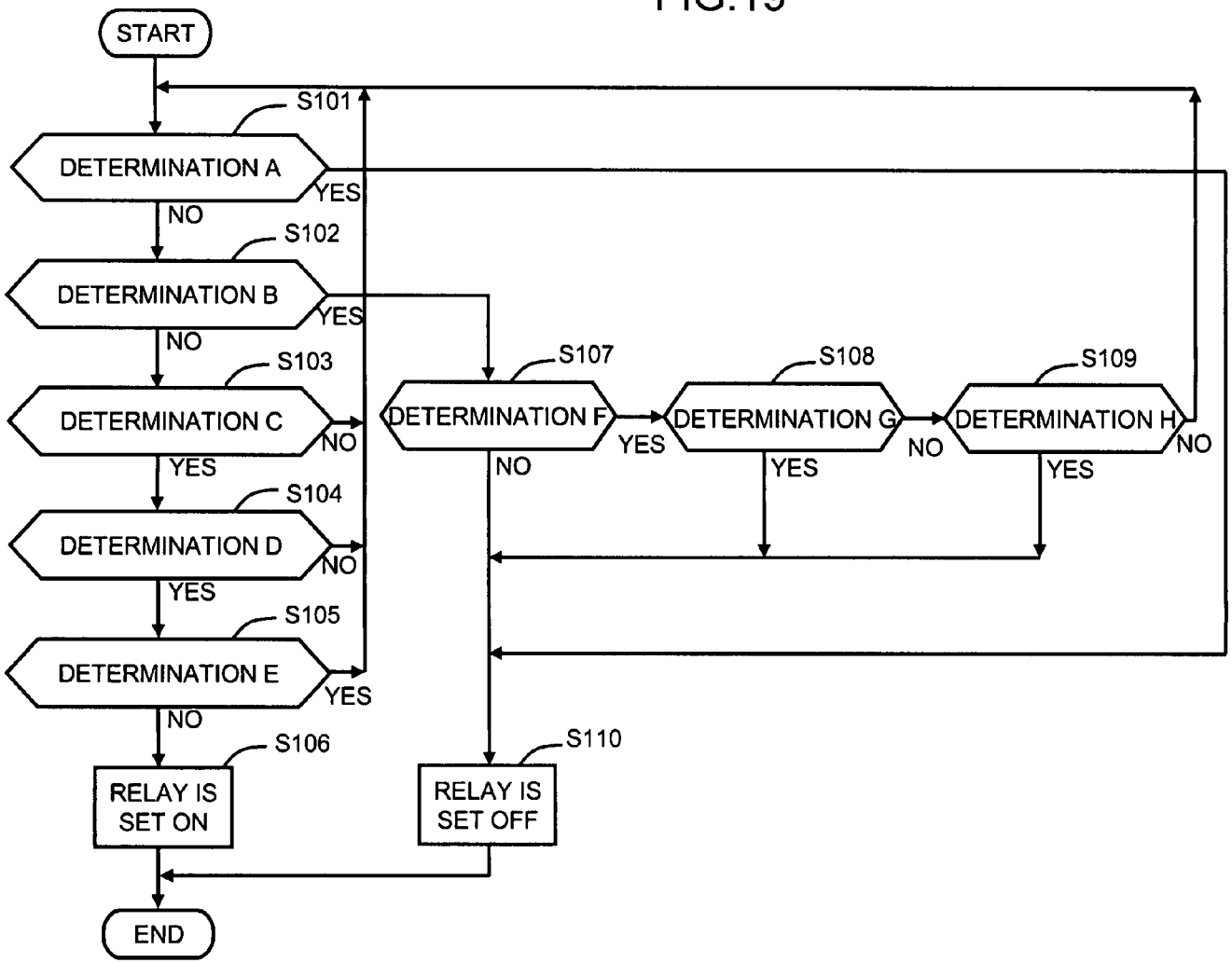
[FIG. 19]

FIG. 19 shows a flowchart of relay ON/OFF switching control.

The digging operation detection unit 213 of the controller 200 performs a determination A (S101). The determination A is a determination as to whether or not the swash plate control cancel switch 150 is ON. Where the result of determination A is affirmative (S101: YES), the swash plate angle control unit 212A increases the amount of fluid supplied to the boom cylinder 128 by switching OFF the relay 216 (S110).

Where the result of determination A is negative (S101: NO), the digging operation detection unit 213 performs a determination B (S102). The determination B is a determination as to whether or not the relay 216 is ON (for example, whether an electric signal for switching ON the relay 216 has been outputted).

Where the result of determination B is negative (S102: NO), the digging operation detection unit 213 determines whether the first digging operation condition has been satisfied. More specifically, the digging operation detection unit 213 performs a determination C (S103) and when the result of determination C is negative (S103: YES), performs a determination D (S104). The determination C is a determination as to whether or not the gear ratio set for the transmission 112 is a predetermined gear ratio (for example, first forward gear ratio). The determination D is a determination as to whether or not the boom bottom pressure has exceeded a first predetermined value.

When the results of both the determination C and the determination D are negative (S103: YES and S104: YES), the digging operation detection unit 213 performs determination E (S105). The determination E is a determination as to whether or not a loading operation is being performed. For example, when the loading operation flag stored in the memory 220 is a predetermined value (for example, "1"), it is determined that a loading operation is being performed in the determination E. Otherwise, it is determined that a loading operation is not being performed.

When the result of determination C and the result of determination D are both affirmative, and the result of determination E is negative (S105: NO), the digging operation detection unit 213 determines that a digging operation is being performed. In this case, the swash plate angle control unit 212A reduces the amount of hydraulic oil supplied to the boom cylinder 128 by switching (S106) the relay 216 from OFF to ON.

When the result of determination C and the result of determination D are both affirmative, and the result of determination E is also affirmative (S105: YES), the digging operation detection unit 213 determines that a digging operation is not performed. In this case, the step S106 is not performed and the step S101 is again executed.

When the result of determination C is affirmative (S102: YES), the digging operation detection unit 213 determines that the digging operation is not performed if any of the above-described plurality of first digging operation conditions and the second digging operation condition, which indicates that the loading operation is not performed, is not satisfied. More specifically, the digging operation detection unit 213 performs determination F (S107). The determination F is identical to determination C, that is, a determination as to whether or not the gear ratio set for the transmission 112 is a predetermined gear ratio (for example, first forward gear ratio). When the result of determination F is affirmative (S107: YES), the digging operation detection unit 213 performs determination G (S108). The determination G is a determination as to whether or not the boom bottom pressure is less than the second predetermined value. Where the result of determination G is negative (S108: NO), the digging operation detection unit 213 performs determination H (S109). The determination H is identical to determination E, that is, a determination as to whether or not a loading operation is being performed. When the result of determination H is negative (S109: NO), the step S110 is not performed and the step S101 is executed again. However, where the result of determination F is negative (S107: NO), the result of determination G is affirmative (S108: YES), or the result of determination H is affirmative (S109: YES), the swash plate angle control unit 212A increases the amount of hydraulic oil supplied to the boom cylinder 128 by setting the relay 216 OFF (S110).

The flow of relay ON/OFF switching control is described above.

The first predetermined value in S104 and the second predetermined value in S108 may be same or different. For example, the second predetermined value may be a value (for example, 150 kg/cm$^2$) obtained by subtracting a predetermined hysteresis value (for example, 50 kg/cm$^2$) from the first predetermined value (for example, 200 kg/cm$^2$) (in other words, the second predetermined value may be less than the first predetermined value).

Further, the order of S103, S104, and S105 is not limited to that described above and may be any order (for example, S103 or S104 may be performed after S105). Likewise, S107, S108, and S109 may be performed in any order.

Further, for example, in S103 and/or S107, the second determination as to whether or not the vehicle speed detected by a speedometer 149 is less than a predetermined vehicle speed may be performed instead of or in addition to the first determination at to whether or not the gear ratio set for the transmission 112 is a predetermined gear ratio (for example, first forward gear ratio). The result of determination of S103 and/or S107 is affirmative when the result of the second determination is affirmative instead of or in addition to the result of the first determination being affirmative.

The present embodiment has the above-described configuration and therefore demonstrates, for example, the following effects.

In the present embodiment, the processing of reducing the amount of hydraulic oil supplied to the boom cylinder 128 is generally executed when the digging operation condition is satisfied (more specifically, the first digging operation conditions are satisfied) and when it is not detected that a loading operation is being performed (more specifically, the second digging operation condition is not satisfied). As a result, it is possible to prevent an unnecessarily large amount of hydraulic oil from being supplied to the boom cylinder 128 during a digging operation.

On the other hand, in the present embodiment, the processing of reducing the amount of hydraulic oil supplied to the boom cylinder 128 is not executed when it is detected that a loading operation is being performed (more specifically, the second digging operation condition is not satisfied) even if the digging operation condition is satisfied (more specifically, the first digging operation conditions are satisfied). As a result, it is possible to prevent the amount of hydraulic oil supplied to the boom cylinder 128 from being reduced during a loading operation.

In the present embodiment, the state of loading operation can be automatically detected on the basis of variations in predetermined parameters such as the boom lever operation amount and boom angle. Therefore, control corresponding to the loading operation can be performed and performance of the wheel loader 1 is improved.

In the present embodiment, the flow rate of hydraulic oil supplied to the boom cylinder 128 is increased in the loading operation. Therefore, it is possible to increase the rise speed of the boom 51, shorten the time required for the loading operation, and improve the working efficiency. Further, since the flow rate of hydraulic oil to the boom cylinder 128 is increased automatically when the loading operation is started, it is not necessary for the operator to conduct extra operations, e.g. operate the brake pedal or the like, and the operability during loading operation is increased.

In the present embodiment, the loading operation is determined to be started when the conditions (S10, S11) for actively detecting whether the loading operation is being performed and conditions (S12, S13) for preventing erroneous detection are all fulfilled. Therefore, the start of loading operation can be determined with better reliability.

In the present embodiment, where it is detected that the loading operation is being performed, the first to fourth fluid amount increase processing operations (S21 to S24) are executed. Therefore, a large amount of the hydraulic oil can be supplied to the boom cylinder 128 and the boom 51 can be rapidly raised.

[Embodiment 2]

A variation example of the processing of detecting the loading operation, namely, a variation example of the loading operation detection unit 211, will be explained below. The following embodiments correspond to variation examples of the first embodiment.

Figure 11:
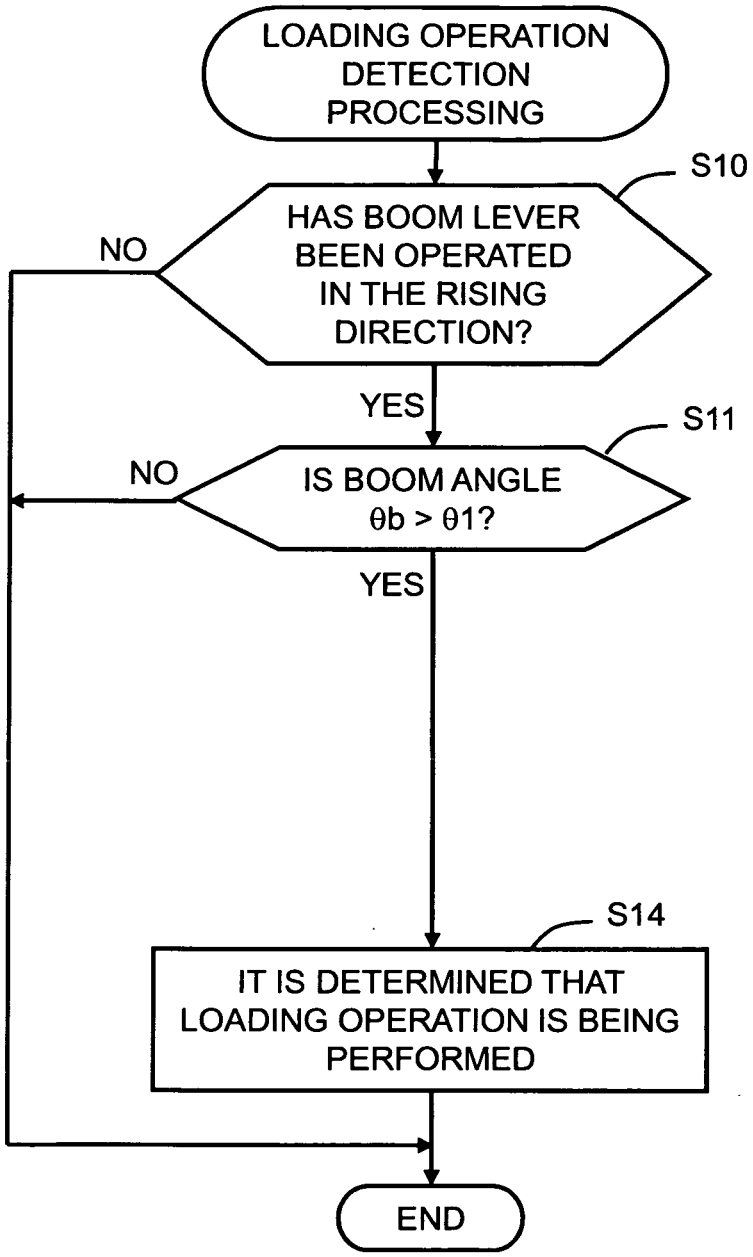
[FIG. 11]

As shown in FIG. 11, in the second embodiment the loading operation detection unit 211 detects whether the boom lever 126 has been operated in the direction of rising (S10) and also determines whether the boom angle θb is greater than the predetermined value θ1 (S11). When both conditions are fulfilled, it is determined that the loading operation is being performed (S14).

In the present embodiment of such a configuration, the effect similar to that of the first embodiment is demonstrated. In the present embodiment the processing of detecting the loading operation is simplified with respect to that of the first embodiment. Therefore, the control program can be simplified with respect to that of the first embodiment.

[Embodiment 3]

Figure 12:
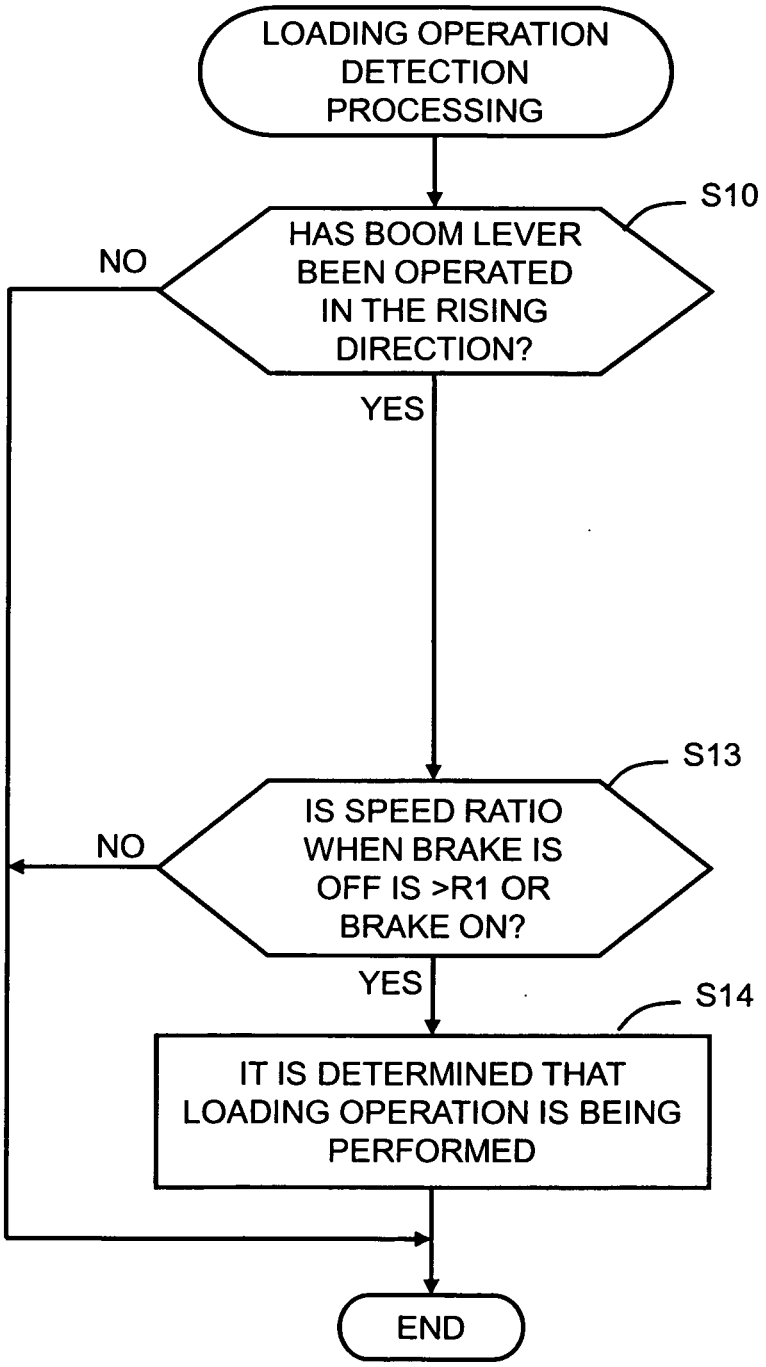
[FIG. 12]

As shown in FIG. 12, in the third embodiment, the loading operation detection unit 211 determines the first condition (S10) and fourth condition (S13) described in the first embodiment and determines that the loading operation is being performed when both conditions are fulfilled (S14). In the embodiment of such a configuration, the effect similar to that of the second embodiment is demonstrated.

[Embodiment 4]

Figure 13:
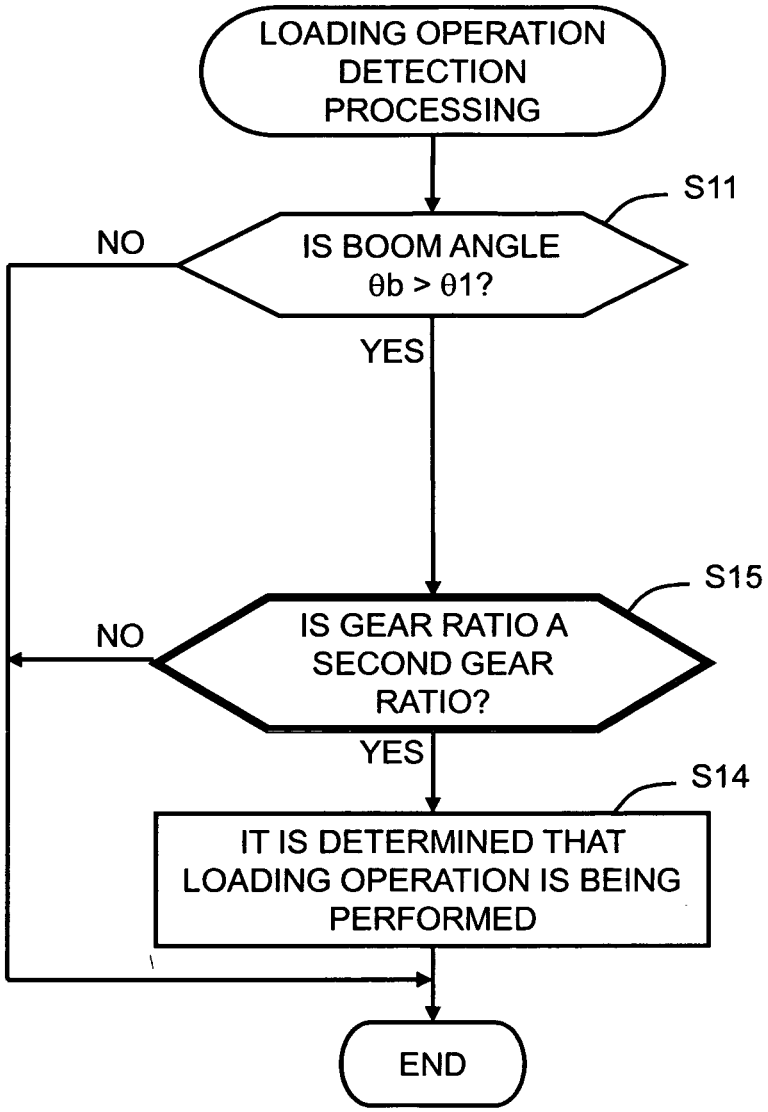
[FIG. 13]

As shown in FIG. 13, in the fourth embodiment, the loading operation detection unit 211 determines whether the boom angle θb is greater than the predetermined value θ1 (S11) and also determines whether the second forward gear ratio has been set (S15). When both conditions are fulfilled, it is determined that the loading operation is being performed (S14). During the loading operation, since the working vehicle approaches the dump truck 10 in a state in which the load is accommodated in the bucket 52, the transmission 112 is often set to the second forward gear ratio.

However, the present invention is not limited to the second forward gear ratio. Thus, in S15, it is determined whether the gear ratio is a predetermined gear ratio that has been set in advance. In the present embodiment, a second gear ratio is taken as an example of the predetermined gear ratio. In the embodiment of such a configuration, the effect similar to that of the second embodiment is also demonstrated.

[Embodiment 5]

Figure 14:
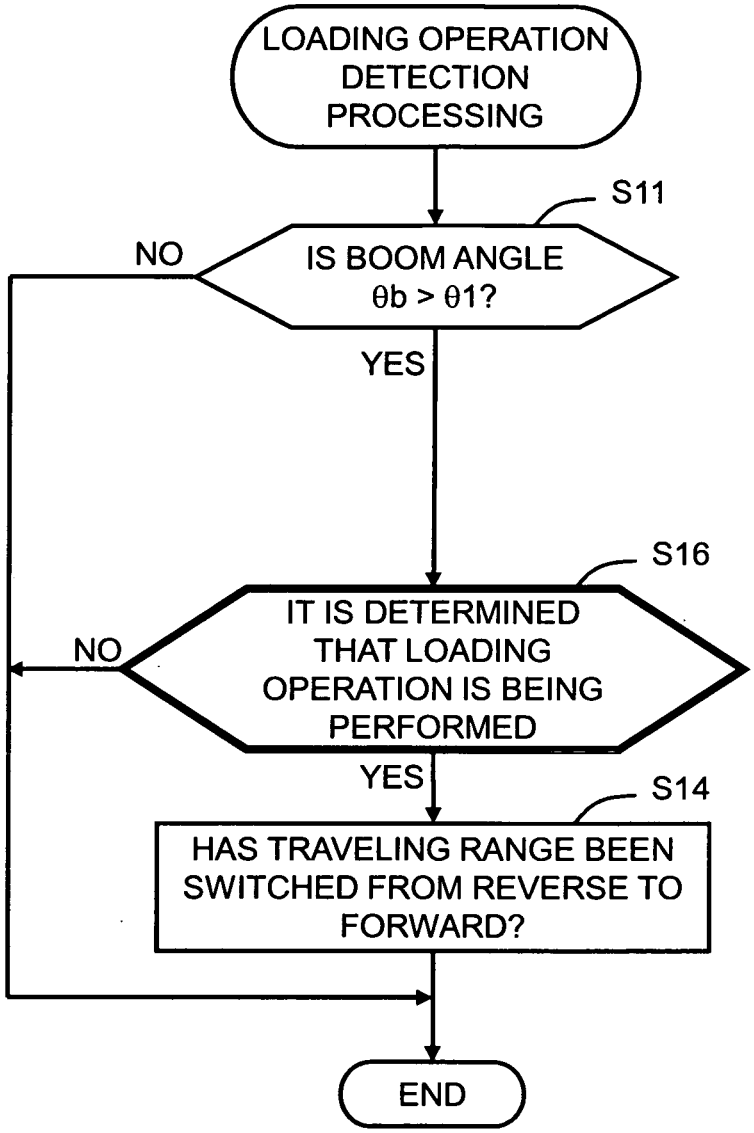
[FIG. 14]

As shown in FIG. 14, in the fifth embodiment, the loading operation detection unit 211 determines whether the boom angle θb is greater than the predetermined value θ1 (S11) and also determines whether the traveling range has been switched from reverse to forward (S16). When both conditions are fulfilled, it is determined that the loading operation is being performed (S14).

As shown in FIG. 5, when a transition is made from the operation step P2 to the operation step P3, the traveling range is switched from reverse to forward. Therefore, this change in the traveling range can be used as information for detecting the start of loading operation. In the embodiment of such a configuration, the effect similar to that of the second embodiment is also demonstrated.

[Embodiment 6]

Figure 15:
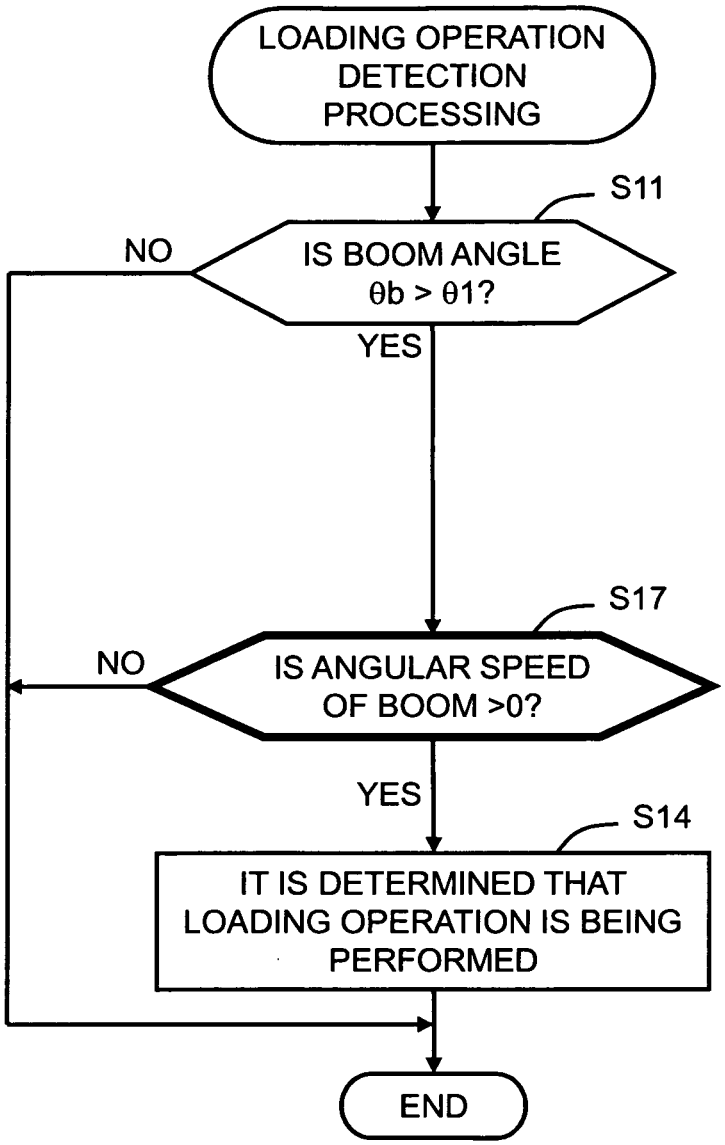
[FIG. 15]

As shown in FIG. 15, in the sixth embodiment, the loading operation detection unit 211 determines whether the boom angle θb is greater than the predetermined value θ1 (S11) and also determines whether the angular speed of the boom 51 is greater than zero (S17). When both conditions are fulfilled, it is determined that the loading operation is being performed (S14).

During the loading operation, the boom 51 is lifted, while the working vehicle travels towards the dump truck 10. The cylinder rod of the boom cylinder 128 is extended thereby rotating the boom 51 upward. The boom cylinder 128 rotates clockwise about the rotation fulcrum at the proximal end side thereof correspondingly to the extension of the cylinder rod of the boom cylinder 128. Therefore, where the boom 51 is lifted can be determined by finding the angular speed of the boom 51 on the basis of the detection signal from the boom angle sensor 143.

In the embodiment of such a configuration, the effect similar to that of the second embodiment is also demonstrated. Further, the angular speed of the boom 51 can be also detected as an angular speed of the boom cylinder 128. Further, a configuration may be also used in which whether the extension speed of the cylinder rod of the boom cylinder 128 is equal to or greater than zero is determined instead of determining the angular speed. The extension speed of the cylinder rod may be calculated from the angular speed of the boom cylinder 128, and the extension speed of the cylinder rod may be calculated by using a linear sensor that directly detects the displacement of the cylinder rod.

[Embodiment 7]

Figure 16:
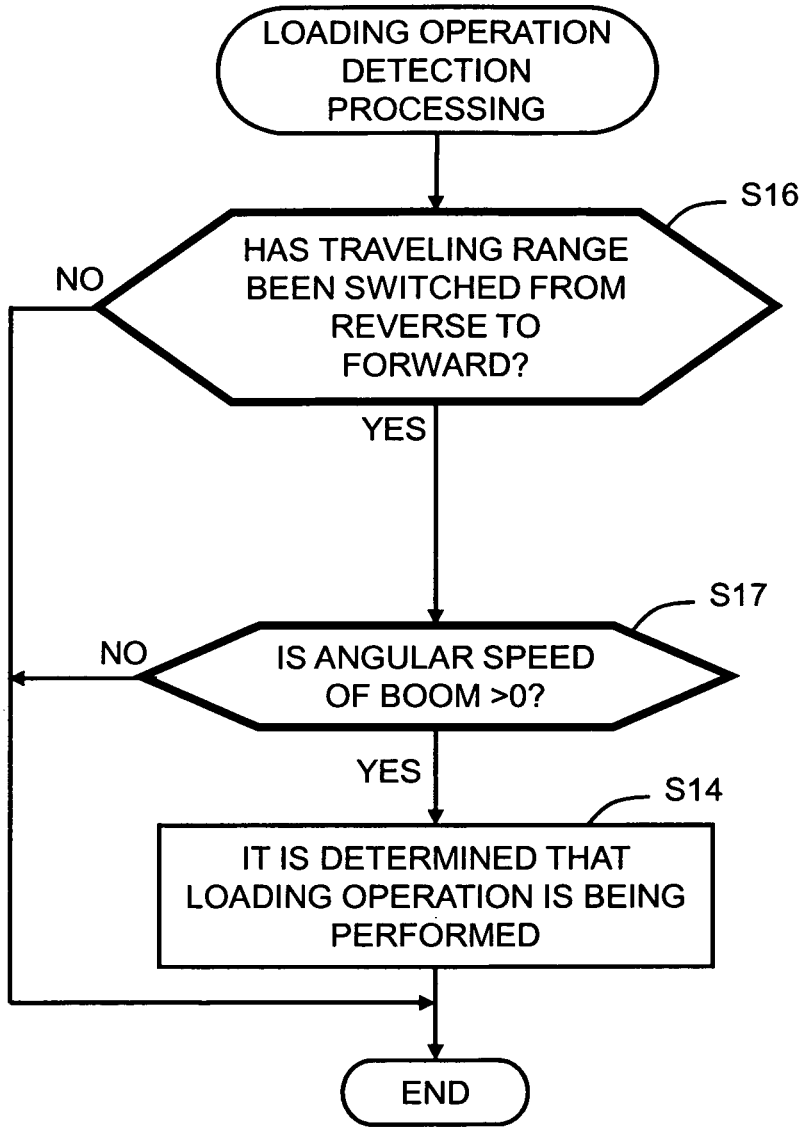
[FIG. 16]

As shown in FIG. 16, in the seventh embodiment, the loading operation detection unit 211 determines whether the traveling range has been switched from reverse to forward (S16) and also determines whether the angular speed of the boom 51 is equal to or greater than zero (S17). When both conditions are fulfilled, it is determined that the loading operation is being performed (S14). In the present embodiment of such a configuration, the effect similar to that of the second embodiment is demonstrated

[Embodiment 8]

As shown in FIG. 17, in the eighth embodiment, the loading operation detection unit 211 determines whether the boom angle θb is in a "Carry Position" (S11A), instead of S11 in FIG. 9. The "Carry Position" is defined by the SAE standard and ISO standard. Therefore, S11A may be called a step of "determining whether the "Carry Position" stipulated by the SAE or ISO standard is assumed". In the embodiment of such a configuration, the effect similar to that of the second embodiment is also demonstrated.

[Embodiment 9]

Figure 18:
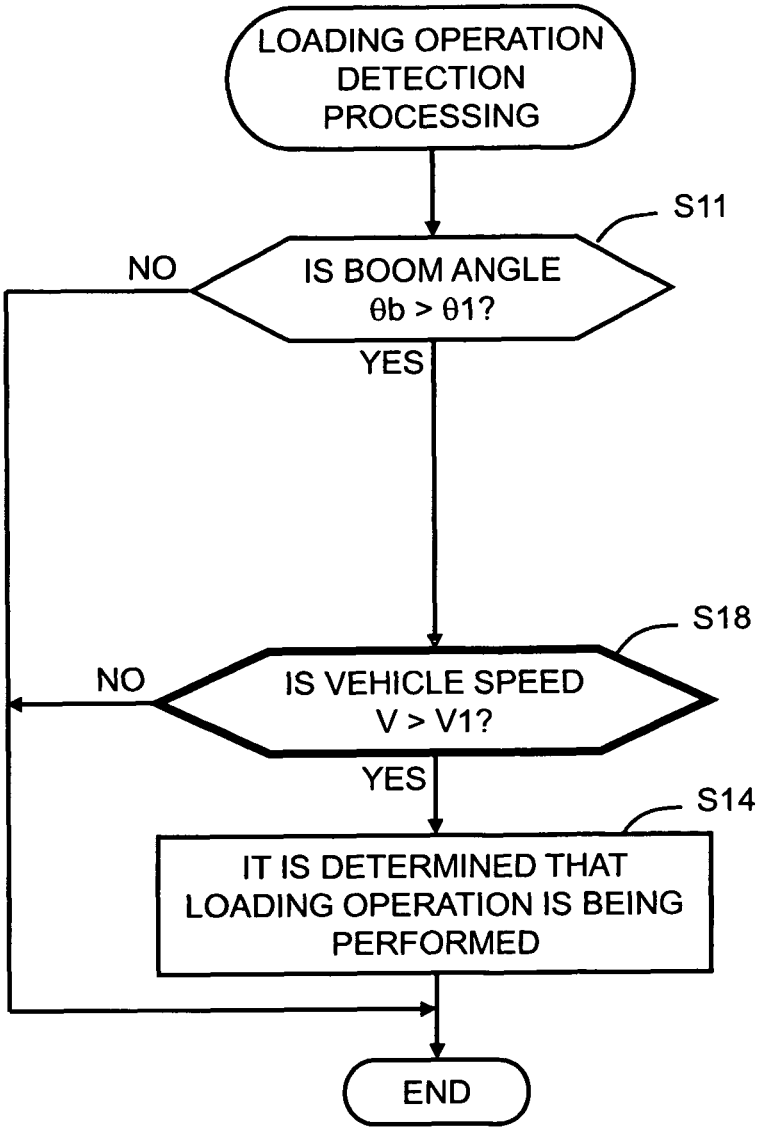
[FIG. 18]

As shown in FIG. 18, in the ninth embodiment, the loading operation detection unit 211 determines whether the vehicle speed V has exceeded a predetermined speed V1 that has been set in advance (S18) instead of S15 in FIG. 13. When the boom angle θb exceeds θ1 (S11: YES) and the vehicle speed V exceeds V1, it can be determined that the loading operation is being performed.

Several embodiments of the present invention are described above. However, these embodiment merely serve to illustrate the present invention, and the scope of the invention is not limited to these embodiments. The present invention can be implemented in variety of other modes, without departing from the essence thereof.

For example, in the embodiments, the following types of information are listed as information for determining that the loading operation is being performed: whether the boom lever has been operated in the direction of rising, whether the boom angle is equal to or greater than a predetermined value, whether the boom angle is in a "Carry Position", whether the boom angle is less than an upper limit angle, whether the speed ratio when the brake is off is equal to or greater than a predetermined value, whether a predetermined gear ratio has been selected, whether the traveling range has been switched from reverse to forward, and whether the angular speed of the boom (angular speed of the boom cylinder) is equal to or greater than a predetermined value. Further, in the embodiments, a plurality of examples are explained in which the above-listed types of information (parameters) are advantageously combined, but the present invention is not limited to the combinations represented as embodiments and other combinations are also included in the scope of the present invention.

The invention claimed is:

1. A wheel loader that performs both a digging operation and a loading operation, which comprises a boom with a top end, and a bucket rotatably connected to the top end of the boom;

the digging operation for lowering the bucket at the top end of the boom to a location near a ground, placing the bucket into a digging object, and rotating the bucket in a tilt direction to fill a load in the bucket; and the loading operation for raising the boom, approaching a load body and unloading the load in the bucket onto the load body;

the wheel loader further comprising:

a boom cylinder that actuates the boom;

a pump supplying hydraulic oil to the boom cylinder; and a working state detection unit configured to perform a first judgment and a second judgment based on following conditions:

(A) a speed stage indicated by transmission is a predetermined speed stage or a detected vehicle speed is equal to or lower than a predetermined vehicle speed, (B) hydraulic pressure at a bottom side of the boom cylinder exceeds a predetermined value, (C) movement of the boom lever in an operational direction to raise the boom, and (D) an angle of the boom is equal to or greater than a predetermined angle; and the first judgment determines whether the conditions (A) and (B) are satisfied and returns an affirmative result when both the conditions (A) and (B) are satisfied, and when the first judgment is affirmative, the second judgment determines, whether either of the conditions (C) and (D) is satisfied and returns a negative result when neither the condition (C) nor the condition (D) is satisfied; and a fluid amount control unit configured to execute fluid amount reduction control and reduce the amount of hydraulic oil supplied from the pump, when the result of the second judgment is negative.

2. The wheel loader according to claim 1, further comprising:

an engine;

a distributor that distributes an output from the engine to a traveling system and a hydraulic device system, the traveling system including a modulation clutch connected to the distributor and a transmission, the modulation clutch being configured to connect, separate and slide along an axis of the output from the engine and an axis of an input of the transmission; and the hydraulic device system having the boom cylinder, the second judgment is further configured to determine whether two additional conditions are satisfied and to judge that the wheel loader is in the loading operation when the two additional conditions are satisfied, the two conditions are grouped into of first and second conditions and another group of another first and second conditions, as follows:

the first condition that determines whether the wheel loader is in the loading operation based on a condition related to an expression of operator's will, the second condition that is an error detection prevention condition for preventing erroneous detection of the wheel loader being in the loading operation that is based on a condition related to a travelling system state of the wheel loader, the another first condition that the boom lever is operated so as to raise the boom, and the another second condition that a ratio of input rotational speed and output rotational speed of the modulation clutch at the time of brake off is equal to or greater than a predetermined value.

3. A control device for a wheel loader that performs both a digging operation and a loading operation, which comprises a boom with a top end, and a bucket rotatably connected to the top end of the boom;

the digging operation for lowering the bucket at the top end of the boom to a location near a ground, placing the bucket into a digging object, and rotating the bucket in a tilt direction to fill a load in the bucket; and the loading operation for raising the boom, approaching a load body and unloading load from the bucket onto the load body;

the control device comprising:

a working state detection unit configured to perform a first judgment and a second judgment based on following conditions:

(A) a speed stage indicated by transmission is a predetermined speed stage or a detected vehicle speed is equal to or lower than a predetermined vehicle speed, (B) hydraulic pressure at a bottom side of the boom cylinder exceeds a predetermined value, (C) movement of the boom lever in an operational direction to raise the boom, and (D) an angle of the boom is equal to or greater than a predetermined angle; and the first judgment determines whether the conditions (A) and (B) are satisfied, returns an affirmative result when both the conditions (A) and (B) are satisfied, and when the first judgment is affirmative, the second judgment determines, whether either of the conditions (C) and (D) is satisfied and returns a negative result when neither the condition (C) nor the condition (D) is satisfied; and a fluid amount control unit configured to execute fluid amount reduction control and reduce the amount of hydraulic oil supplied from a pump to a boom cylinder, when a result of the second judgment is negative.

4. A method for controlling supply of hydraulic oil amount of a wheel loader, the method comprising both digging and loading operations, the digging operation including lowering a bucket at a top end of a boom to a location near a ground, placing the bucket into a digging object, and rotating the bucket in a tilt direction to fill a load into the bucket; and the loading operation including raising the boom, approaching a load body and unloading the load from the bucket onto the load body;

performing first and second judgments based on following conditions:

(A) a speed stage indicated by transmission is a predetermined speed stage, or detected vehicle speed is equal to or lower than a predetermined vehicle speed, (B) hydraulic pressure at a bottom side of the boom cylinder exceeds a predetermined value, (C) movement of the boom lever in an operational direction to raise the boom, and (D) an angle of the boom is equal to or greater than a predetermined angle the first judgment determining whether the conditions (A) and (B) are satisfied and returning an affirmative result when both the conditions (A) and (B) are satisfied, and when the first judgment is affirmative, the second judgment determining whether either of the conditions (C) and (D) is satisfied and returning a negative result when neither the condition (C) nor the condition (D) is satisfied; and executing fluid amount reduction control and reducing the amount of hydraulic oil supplied from a pump to a boom cylinder, when the result of the second judgment is negative.

* * * * *